US009908150B2

(12) United States Patent
Lipa et al.

(10) Patent No.: US 9,908,150 B2
(45) Date of Patent: Mar. 6, 2018

(54) POLYURETHANE SCREEN

(71) Applicant: Derrick Corporation, Buffalo, NY (US)

(72) Inventors: Anythony J Lipa, Williamsville, NY (US); James R Colgrove, East Aurora, NY (US)

(73) Assignee: Derrick Corporation, Buffalo, NY (US)

( * ) Notice: Subject to any disclaimer, the term of this patent is extended or adjusted under 35 U.S.C. 154(b) by 0 days.

(21) Appl. No.: 15/196,314

(22) Filed: Jun. 29, 2016

(65) Prior Publication Data

US 2016/0303611 A1 Oct. 20, 2016

Related U.S. Application Data

(60) Division of application No. 14/663,037, filed on Mar. 19, 2015, now Pat. No. 9,403,192, which is a continuation-in-part of application No. 13/838,968, filed on Mar. 15, 2013, now Pat. No. 9,010,539, which is a continuation-in-part of application No. 12/763,046, filed on Apr. 19, 2010, now Pat. No. 8,584,866.

(51) Int. Cl.
*B07B 1/49* (2006.01)
*B07B 1/46* (2006.01)

(52) U.S. Cl.
CPC ..... *B07B 1/4609* (2013.01); *B07B 1/4618* (2013.01)

(58) Field of Classification Search
CPC ..... B07B 1/46; B07B 1/4609; B07B 1/4618
USPC ..... 209/392, 393, 395
See application file for complete search history.

(56) References Cited

U.S. PATENT DOCUMENTS

| | | | | |
|---|---|---|---|---|
| 4,028,230 | A | 6/1977 | Rosenblum | |
| 4,100,248 | A | 7/1978 | Adams | |
| 4,222,865 | A | 9/1980 | Valeri et al. | |
| 4,383,919 | A | 5/1983 | Schmidt | |
| 4,819,809 | A * | 4/1989 | Derrick | B07B 1/4609 209/275 |
| 4,857,176 | A * | 8/1989 | Derrick | B07B 1/4609 209/392 |
| 5,385,669 | A | 1/1995 | Leone, Sr. | |
| 5,876,552 | A | 3/1999 | Bakula | |
| 7,000,777 | B2 | 2/2006 | Adams et al. | |
| 7,484,625 | B2 | 2/2009 | Scott et al. | |

(Continued)

FOREIGN PATENT DOCUMENTS

WO 2001/097947 12/2001

*Primary Examiner* — Terrell H Matthews
(74) *Attorney, Agent, or Firm* — Jason P. Mueller; Adams & Reese, LLP

(57) ABSTRACT

A molded polyurethane vibratory screen including a body having opposite side edge portions, upper and lower edge portions, an upper surface and a lower surface, first members extending between the side edge portions and the second members extending between the lower edge portion and the upper edge portion, third members substantially parallel and extending transversely between the side edge portions and having multiple first members therebetween, the fourth members substantially parallel and extending transversely between the lower edge portion and the upper edge portion and having multiple second members therebetween, reinforcement members molded integrally with the third and fourth members.

62 Claims, 20 Drawing Sheets

(56) References Cited

U.S. PATENT DOCUMENTS

| | | | | |
|---|---|---|---|---|
| 8,584,866 | B2 * | 11/2013 | Lipa | B07B 1/40 156/308.2 |
| 9,010,539 | B2 * | 4/2015 | Lipa | B07B 1/4618 209/392 |
| 2004/0211707 | A1 | 10/2004 | Lipa | |
| 2005/0183991 | A1 * | 8/2005 | Kriel | B07B 1/4645 209/13 |
| 2013/0277282 | A1 | 10/2013 | Lipa et al. | |

* cited by examiner

FIGURE 1
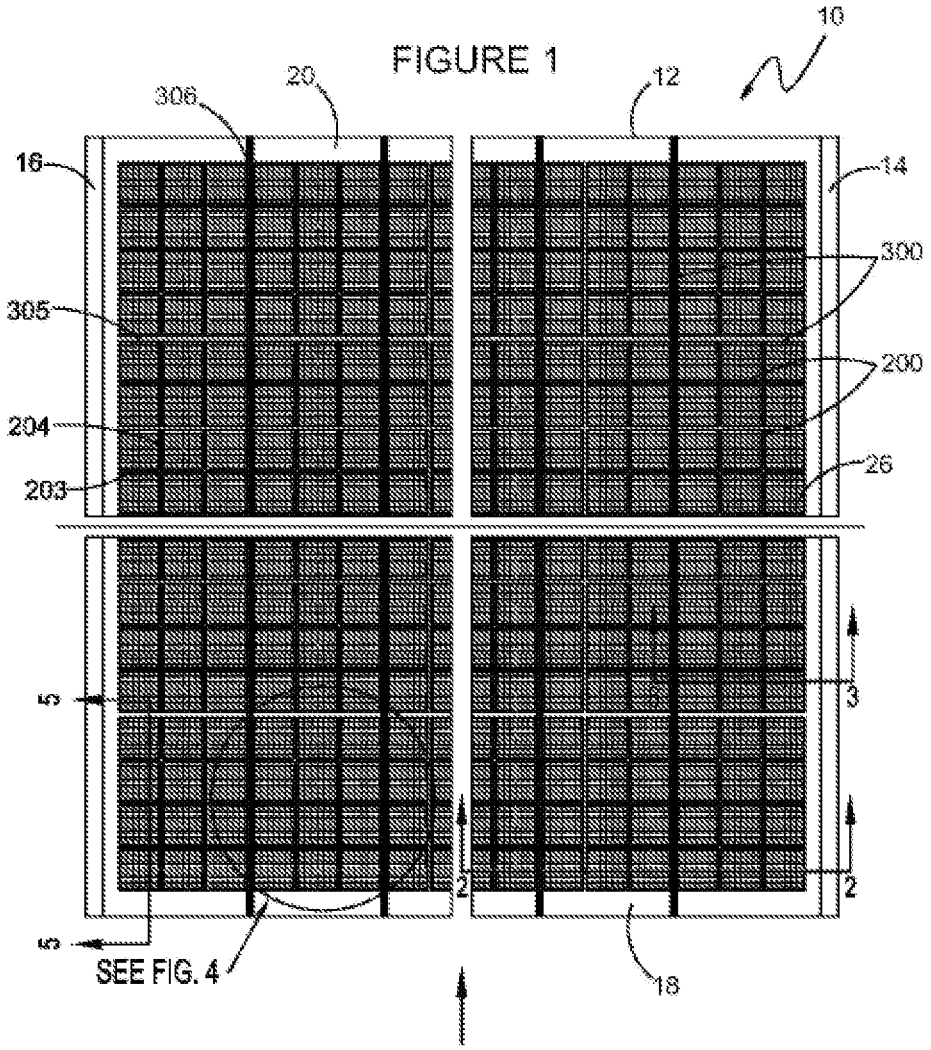
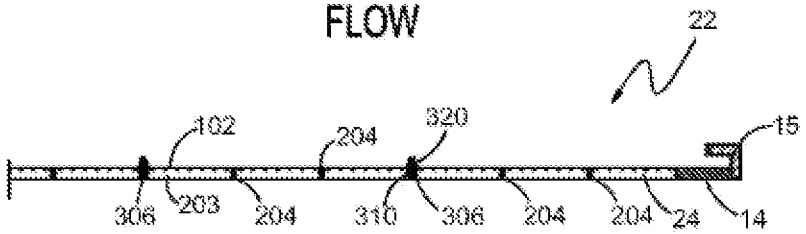
FIGURE 2

FRONT TO BACK
W/ REINFORCEMENT RODS

FRONT TO BACK
SCREEN FRAME
W/ SCREEN PANEL

Screen Frame
w/ Side to Side Panel

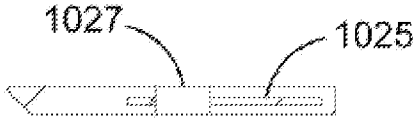
SECTION A-A
FIGURE 16A
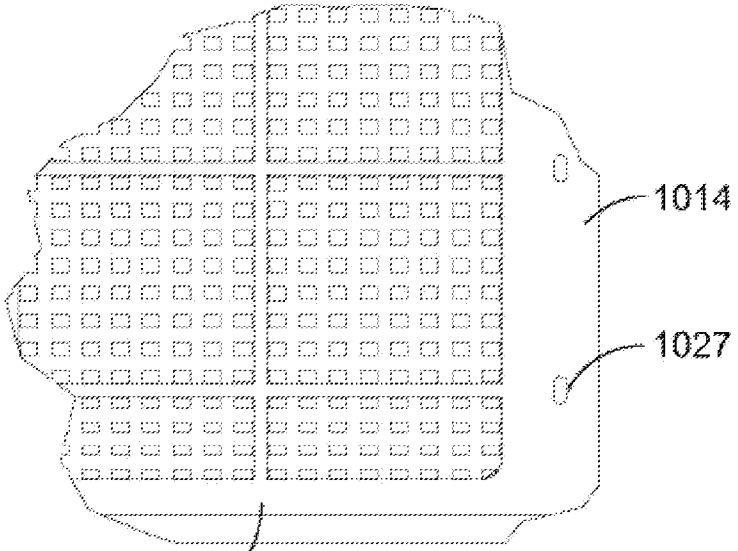
DETAIL A
FIGURE 16B
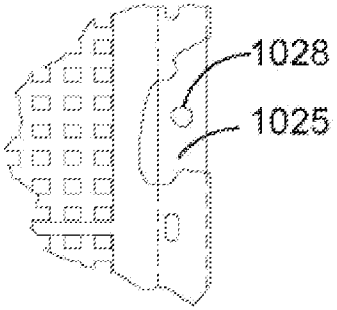
DETAIL B
FIGURE 16C
FIGURE 16

POLYURETHANE SCREEN

CROSS-REFERENCE TO RELATED APPLICATIONS

The present disclosure is a divisional of U.S. patent application Ser. No. 14/663,037, entitled "Polyurethane Screen," filed on Mar. 19, 2015, which is a continuation-in-part of U.S. patent application Ser. No. 13/838,968, entitled "Polyurethane Vibratory Screen," filed on Mar. 15, 2013, which is a continuation-in-part of U.S. patent application Ser. No. 12/763,046, now U.S. Pat. No. 8,584,866, filed Apr. 19, 2010, all of which are expressly incorporated herein in their entirety by reference hereto.

FIELD OF THE INVENTION

The present invention relates to an improved molded polyurethane screen.

BACKGROUND

Molded polyurethane screens having reinforcement therein are known in the art. However, in the past the dividing strips between the openings were relatively large, thereby causing the open area of the screen to be an undesirably low percentage of its surface, thereby in turn causing the screen to be relatively inefficient.

The present invention is an improvement over U.S. Pat. Nos. 4,819,809 and 4,857,176, both of which are expressly incorporated herein by reference hereto. The present invention provides improved screens with relatively high percentage open screening areas and high efficiencies.

The present invention also provides improved screens and screen deck assemblies that may be used in screening machines such as those described in U.S. Pat. Nos. 6,070,736, 8,113,358, 8,522,981, and U.S. Patent Pub. No. 2011/0036759, all of which are expressly incorporated herein by reference hereto. These screening machines, referred to as attrition screening devices, including for example, sifters, gyratory sifters, or graters, include a class of vibratory devices used to separate sized particles, as well as to separate solids from liquids. Sifters are used to screen, for example, minerals, feed material, plastic resins, and powders during industrial sorting and/or manufacturing operations.

Because sifters may be in continuous use, repair operations and associated downtimes need to be minimized as much as possible. Sifters currently include screening assemblies that have a plate or frame as a base and a wire mesh, cloth, or other perforated filter overlay positioned as a screen over the plate or frame. These filter screens often wear out over time due to the particular motion in the sifters, and subsequently require replacement. Screens currently being used in these sifters often wear out in three weeks or less. Also, woven wire cloth screens are problematic in that they can have inconsistent openings, sizes, or other irregularities due to inaccuracies in the weaving process.

Existing screens used in sifters are generally placed on a "ball tray" or "ball box" that captures a number of balls or other agitation producing members which repeatedly impact the screen assembly to dislodge particulate material that accumulates in the screen openings and thus helps de-blind the screens. Blinding is often a serious problem with woven wire cloth screens. The ball tray or box is cumbersome, has loose balls, and is often heavy. In some instances, the screens and/or ball trays or boxes in sifters have to be replaced at least twice a week. Further, the specific motion of the sifter may cause the ball trays or boxes to emit hazardous particles into the air that may then affect the health and safety of the operators of these sifting screening machines. Accordingly, a need exists for screens and screen deck assemblies to be used in these sifting screening machines that are safer, longer lasting, more easily removable and replaceable, lighter, provide more consistent and accurate opening sizes than existing screens, and reduces blinding problems without the use of multiple loose impact objects.

SUMMARY

According to an exemplary embodiment of the present invention, a vibratory screen includes: a flexible molded polyurethane body having substantially parallel side edge portions at opposite ends of the body, a lower edge portion substantially perpendicular to the side edge portions, an upper edge portion substantially perpendicular to the side edge portions and opposite the lower edge portion, an upper surface, a lower surface, first and second members forming screening openings and third and fourth members. The first members extend between the side edge portions. The second members extend between the lower edge portion and the upper edge portion. The third and fourth members may have a thickness greater than the first and second members. The third members are substantially parallel and extend transversely between the side edge portions and have multiple first members therebetween. The fourth members are substantially parallel and extend transversely between the lower edge portion and the upper edge portion and have multiple second members therebetween. Reinforcement members are molded integrally with the third and fourth members.

In an example embodiment of the present disclosure, a screen deck assembly is provided that includes a support deck and a first screen, second screen, and third screen. Each screen may include a flexible molded polyurethane body having substantially parallel side edge portions at opposite ends of the body, a lower edge portion transversely disposed between the side edge portions, an upper edge portion disposed between the side edge portions and substantially parallel and opposite to the lower end portion, an upper surface, a lower surface, a first integrally molded grid structure, a second integrally molded grid structure, and a third integrally molded grid structure and screen openings. The first grid structure may include first and second members forming the screening openings. The first members may be substantially parallel and extend transversely between the side edge portions. The second members may be substantially parallel and extend transversely between the lower edge portion and the upper edge portion. The second grid structure may include third and fourth members. The third members may be substantially parallel and extend transversely between the side edge portions and have multiple first members therebetween. The fourth members may be substantially parallel and extend transversely between the lower edge portion and the upper edge portion and have multiple second members therebetween. The third grid structure may include fifth and sixth members. The fifth members may be substantially parallel and extend transversely between the side edge portions and have multiple third members therebetween. The sixth members may be substantially parallel and extend transversely between the lower edge portion and the upper edge portion and have multiple fourth members therebetween. A reinforcement member may be molded integrally with at least one of the first, third, and fifth members and at least one of the second, fourth, and sixth members. The first members may include reinforcement members molded integrally therewith, the reinforcement members having a thickness in the range of about 0.006 inches to about 0.015 inches. The second members may include reinforcement members molded integrally therewith, the reinforcement members having a thickness in the range of about 0.015 inches to about 0.040 inches. The side edge portions of each of the first, second, and third screens may include attachment arrangements configured to secure the screens to the support deck. The side edge portions of the first, second, and third screens may be secured to the support deck. The first, second, and third screens may be tensioned across the support deck. The first, second, and third screens are tensioned using a plurality of spring clips attached to the support deck. The attachment arrangement may be a grommet. The screen deck assembly may further comprise a cast-in tension strip located within each of the side edge portions such that tension loads applied to the side edge portions are distributed across the screen. The side edge portions may include apertures configured to fill up with polyurethane and suspend the cast-in tension strip in place within the side edge portions of the screen. The screen deck assembly may further comprise an overlap sealing member extending away from an outer edge of at least one of the lower edge portion and the upper edge portion of at least one of the screens. The sealing member may be formed as part of the screens. The sealing member may also be formed as a separate member from the screens. The screen openings may be about 0.044 mm to about 4 mm between inner surfaces of the first members and about 0.044 mm to about 60 mm between inner surfaces of the second members. The reinforcement members may be molded integrally with the first and second members. The reinforcement rods may be molded integrally with at least one of the fourth and sixth members. The reinforcement members may also be molded integrally with the third and fourth members. The reinforcement rods may be molded integrally with at least one of the fourth and sixth members. The reinforcement members may be molded integrally with the fifth and sixth members. The reinforcement rods may be molded integrally with at least one of the fourth and sixth members.

In an example embodiment of the present disclosure, a screen is provided that includes a flexible molded polyurethane body having substantially parallel side edge portions at opposite ends of the body, a lower edge portion transversely disposed between the side edge portions, an upper edge portion disposed between the side edge portions and substantially parallel and opposite to the lower end portion, an upper surface, a lower surface, a first integrally molded grid structure, a second integrally molded grid structure, and a third integrally molded grid structure and screen openings. The first grid structure may include first and second members forming the screening openings. The first members may be substantially parallel and extend transversely between the side edge portions. The second members may be substantially parallel and extend transversely between the lower edge portion and the upper edge portion. The second grid structure may include third and fourth members. The third members may be substantially parallel and extend transversely between the side edge portions and have multiple first members therebetween. The fourth members may be substantially parallel and extend transversely between the lower edge portion and the upper edge portion and have multiple second members therebetween. The third grid structure may include fifth and sixth members. The fifth members may be substantially parallel and extend transversely between the side edge portions and have multiple third members therebetween. The sixth members may be substantially parallel and extend transversely between the lower edge portion and the upper edge portion and have multiple fourth members therebetween. A reinforcement member may be molded integrally with at least one of the first, third, and fifth members and at least one of the second, fourth, and sixth members. The first members may include reinforcement members molded integrally therewith, the reinforcement members having a thickness in the range of about 0.006 inches to about 0.015 inches. The second members may include reinforcement members molded integrally therewith, the reinforcement members having a thickness in the range of about 0.015 inches to about 0.040 inches. The side edge portions of the screen may include attachment arrangements configured to secure the screen to a structural member. The side edge portions of the first, second, and third screens may be secured to the support deck. The attachment arrangement may be a grommet. The screen may further comprise a cast-in tension strip located within each of the side edge portions such that tension loads applied to the side edge portions are distributed across the screen. The side edge portions may include apertures configured to fill up with polyurethane and suspend the cast-in tension strip in place within the side edge portions of the screen. The screen may further comprise an overlap sealing member extending away from an outer edge of at least one of the lower edge portion and the upper edge portion of at least one of the screens. The sealing member may be formed as part of the screen. The sealing member may also be formed as a separate member from the screen. The screen openings may be about 0.044 mm to about 4 mm between inner surfaces of the first members and about 0.044 mm to about 60 mm between inner surfaces of the second members. The reinforcement members may be molded integrally with the first and second members. The reinforcement rods may be molded integrally with at least one of the fourth and sixth members. The reinforcement members may also be molded integrally with the third and fourth members. The reinforcement rods may be molded integrally with at least one of the fourth and sixth members. The reinforcement members may be molded integrally with the fifth and sixth members. The reinforcement rods may be molded integrally with at least one of the fourth and sixth members.

In an example embodiment of the present disclosure, a method for separating materials is provided that includes installing a screen deck assembly in an attrition screening device and sifting the materials. The screen deck assembly includes a support deck and a screen. The screen may include a flexible molded polyurethane body having substantially parallel side edge portions at opposite ends of the body, a lower edge portion transversely disposed between the side edge portions, an upper edge portion disposed between the side edge portions and substantially parallel and opposite to the lower end portion, an upper surface, a lower surface, a first integrally molded grid structure, a second integrally molded grid structure, and a third integrally molded grid structure and screen openings. The first grid structure may include first and second members forming the screening openings. The first members may be substantially parallel and extend transversely between the side edge portions. The second members may be substantially parallel and extend transversely between the lower edge portion and the upper edge portion. The second grid structure may include third and fourth members. The third members may be substantially parallel and extend transversely between the side edge portions and have multiple first members therebetween. The fourth members may be substantially parallel and extend transversely between the lower edge portion and the upper edge portion and have multiple second members therebetween. The third grid structure may include fifth and sixth members. The fifth members may be substantially parallel and extend transversely between the side edge portions and have multiple third members therebetween. The sixth members may be substantially parallel and extend transversely between the lower edge portion and the upper edge portion and have multiple fourth members therebetween. A reinforcement member may be molded integrally with at least one of the first, third, and fifth members and at least one of the second, fourth, and sixth members. The first members may include reinforcement members molded integrally therewith, the reinforcement members having a thickness in the range of about 0.006 inches to about 0.015 inches. The second members may include reinforcement members molded integrally therewith, the reinforcement members having a thickness in the range of about 0.015 inches to about 0.040 inches. The side edge portions of each of the first, second, and third screens may include attachment arrangements configured to secure the screens to the support deck. The side edge portions of the first, second, and third screens may be secured to the support deck. The reinforcement members may be molded integrally with the first and second members. The reinforcement rods may be molded integrally with at least one of the fourth and sixth members. The reinforcement members may also be molded integrally with the third and fourth members. The reinforcement rods may be molded integrally with at least one of the fourth and sixth members. The reinforcement members may be molded integrally with the fifth and sixth members. The reinforcement rods may be molded integrally with at least one of the fourth and sixth members.

In an example embodiment of the present disclosure, a system for separating materials is provided that includes an attrition screening device and a screen deck assembly installed in the attrition screening device for separating the materials. The screen deck assembly includes a support deck and a screen. The screen may include a flexible molded polyurethane body having substantially parallel side edge portions at opposite ends of the body, a lower edge portion transversely disposed between the side edge portions, an upper edge portion disposed between the side edge portions and substantially parallel and opposite to the lower end portion, an upper surface, a lower surface, a first integrally molded grid structure, a second integrally molded grid structure, and a third integrally molded grid structure and screen openings. The first grid structure may include first and second members forming the screening openings. The first members may be substantially parallel and extend transversely between the side edge portions. The second members may be substantially parallel and extend transversely between the lower edge portion and the upper edge portion. The second grid structure may include third and fourth members. The third members may be substantially parallel and extend transversely between the side edge portions and have multiple first members therebetween. The fourth members may be substantially parallel and extend transversely between the lower edge portion and the upper edge portion and have multiple second members therebetween. The third grid structure may include fifth and sixth members. The fifth members may be substantially parallel and extend transversely between the side edge portions and have multiple third members therebetween. The sixth members may be substantially parallel and extend transversely between the lower edge portion and the upper edge portion and have multiple fourth members therebetween. A reinforcement member may be molded integrally with at least one of the first, third, and fifth members and at least one of the second, fourth, and sixth members. The first members may include reinforcement members molded integrally therewith, the reinforcement members having a thickness in the range of about 0.006 inches to about 0.015 inches. The second members may include reinforcement members molded integrally therewith, the reinforcement members having a thickness in the range of about 0.015 inches to about 0.040 inches. The side edge portions of each of the first, second, and third screens may include attachment arrangements configured to secure the screens to the support deck. The side edge portions of the first, second, and third screens may be secured to the support deck. The reinforcement members may be molded integrally with the first and second members. The reinforcement rods may be molded integrally with at least one of the fourth and sixth members. The reinforcement members may also be molded integrally with the third and fourth members. The reinforcement rods may be molded integrally with at least one of the fourth and sixth members. The reinforcement members may be molded integrally with the fifth and sixth members. The reinforcement rods may be molded integrally with at least one of the fourth and sixth members.

Example embodiments of the present invention are described in more detail below with reference to the appended Figures.

BRIEF DESCRIPTION OF THE DRAWINGS

FIG. 1 is a fragmentary plan view of a vibratory screen according to an exemplary embodiment of the present invention;

FIG. 2 is a fragmentary cross sectional view taken substantially along line 2-2 of FIG. 1;

FIG. 16A is a fragmentary cross sectional view taken substantially along Section A-A of FIG. 15;

FIG. 16B is an enlarged fragmentary cross sectional view of a portion of the screen shown in FIG. 15;

FIG. 16C is an enlarged fragmentary cross sectional view of a portion of the screen shown in FIG. 15;

DETAILED DESCRIPTION

Figure 1A:
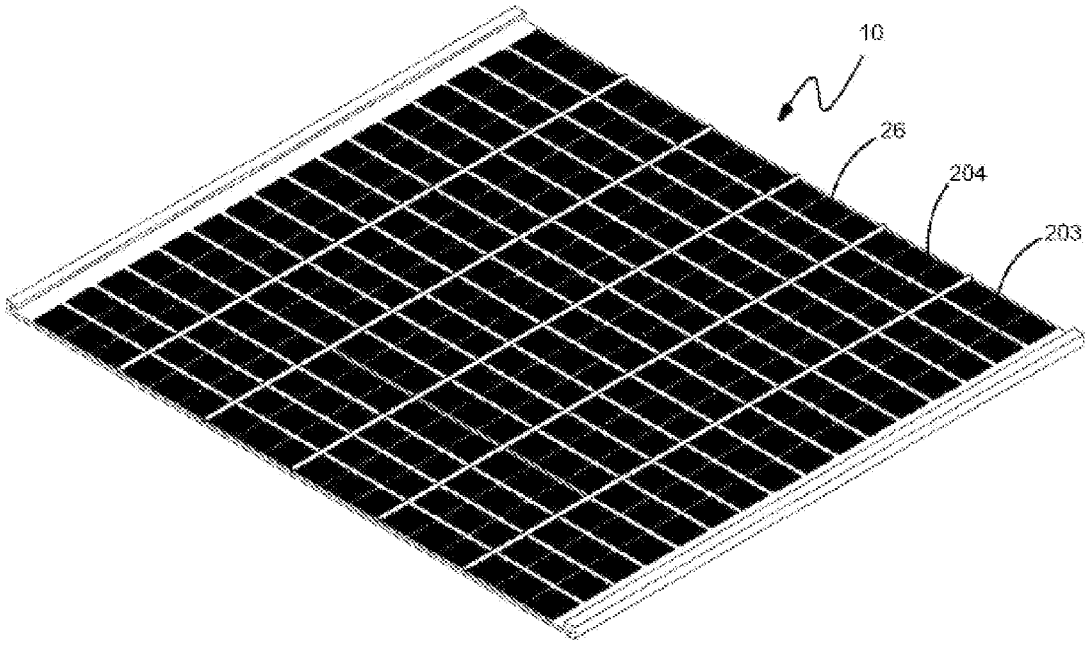
FIG. 1A is a top isometric view of the screen shown in FIG. 1.
Figure 1B:
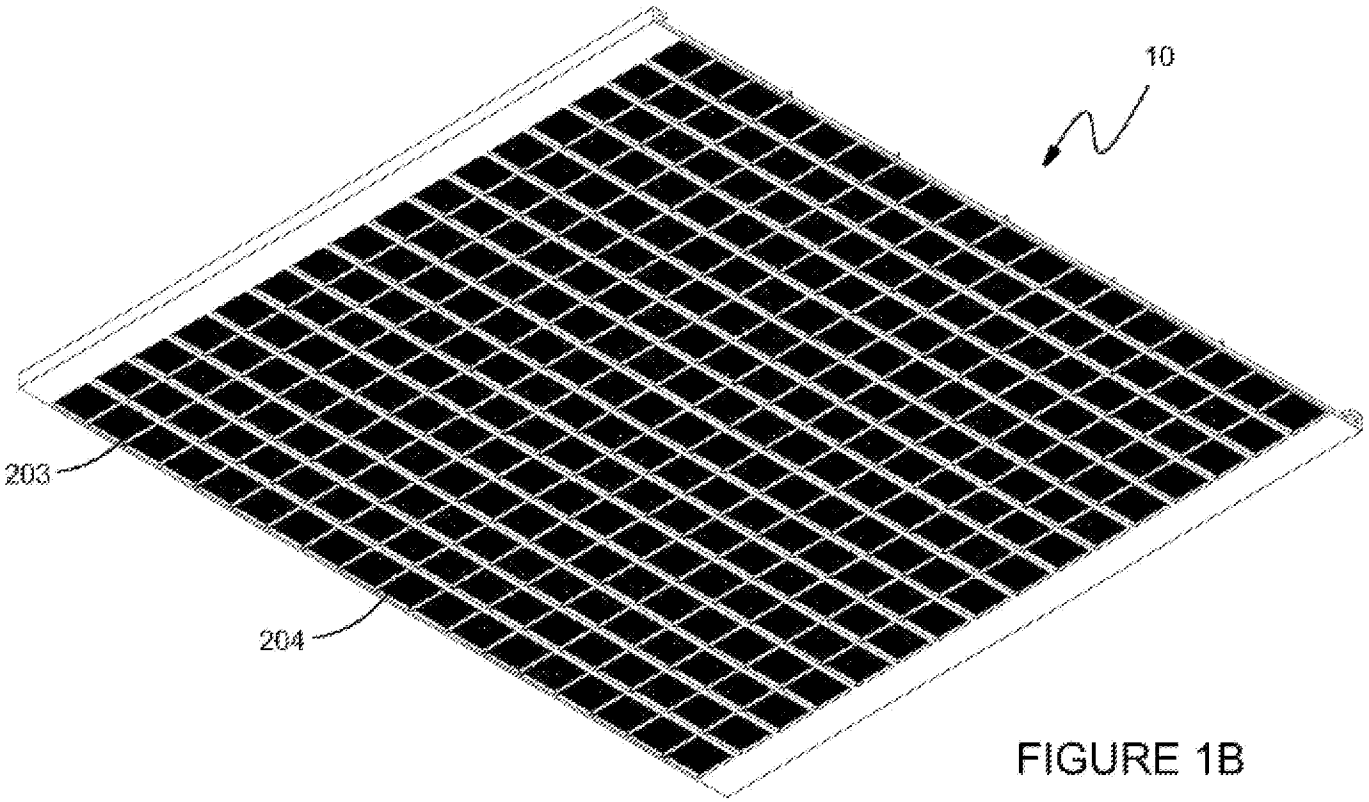
FIG. 1B is a bottom isometric view of the screen shown in FIG. 1.
Figures 3, 3A:
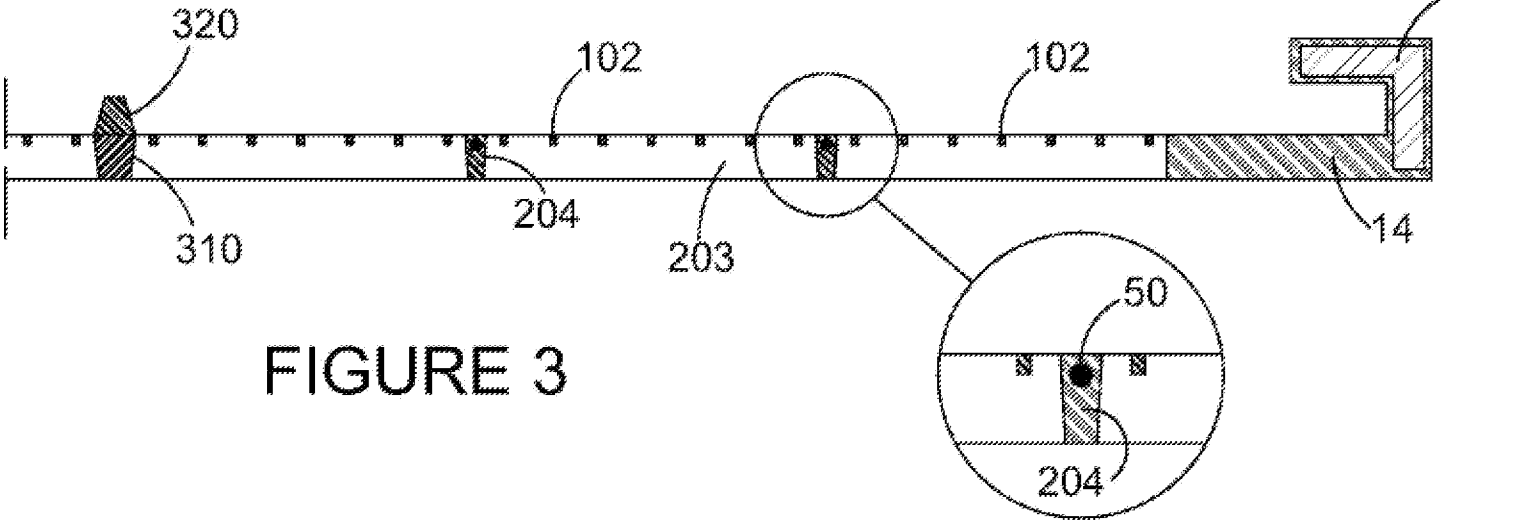
FIG. 3 is a fragmentary cross sectional view taken substantially along line 3-3 of FIG. 1.
FIG. 3A is an enlarged fragmentary cross sectional view of a portion of the screen shown in FIG. 3.

Like reference characters denote like parts in the several Figures. The vibratory screens described herein may be modified as described herein for attachment to a frame or support deck for use with an attrition screening device, including for example, a sifter, gyratory sifter, grater, or similar machine that may be configured to implement motion to the screen such as oscillatory, gyratory, gyratory reciprocating, fully gyratory, rotary, planar, or other type of motion or combinations thereof. Embodiments and features of the screens discussed herein with regard to vibratory screening machines may also be incorporated into screens attached to frames or support decks for use in attrition screening devices, including for example sifters, gyratory sifters, graters, or similar machines.

Figure 11A:
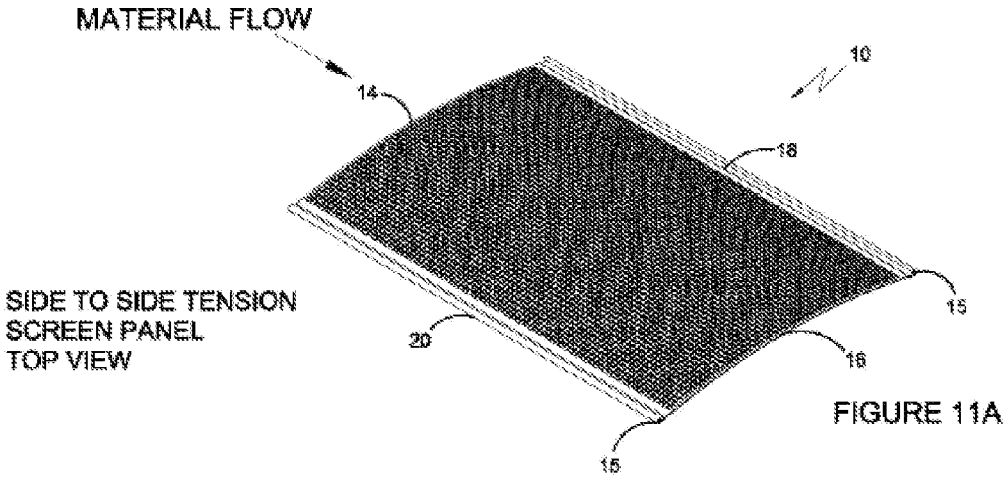
FIG. 11A is a top isometric view of view of a vibratory screen according to an exemplary embodiment of the present invention.
Figure 11B:
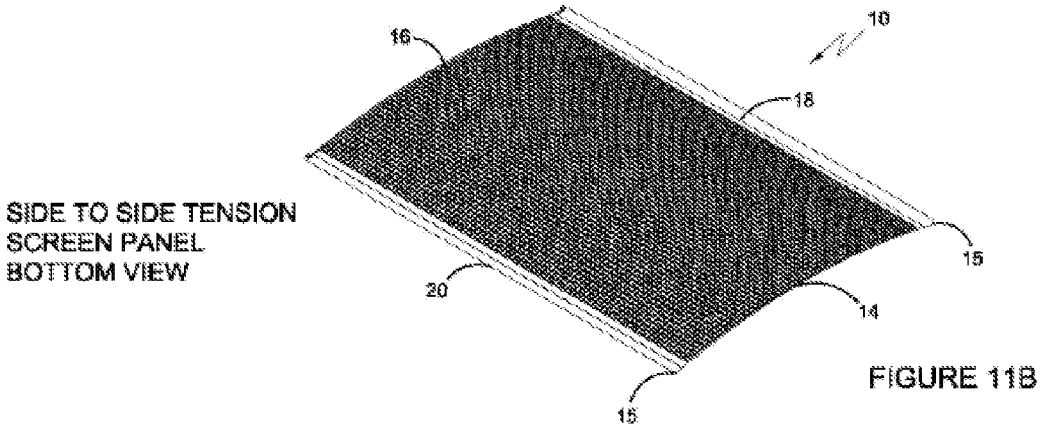
FIG. 11B is a bottom isometric view of the screen shown in FIG. 11A.

According to an exemplary embodiment of the present invention, a vibratory screen 10 includes a body 12 of molded polyurethane having unperforated side edge portions 14, 16. Side edge portions 14, 16 may each have an upward U-shape and may each include a cast-in structural member, such as angle 15 shown in FIG. 2. Side edge portions 14, 16 may also be formed without cast-in structural members and/or may include other structural members. Side edge portions 14, 16 may be formed in a U-shape or any other suitable shape for attachment to a vibratory screening machine. In an exemplary embodiment, side edge portions 14, 16 may include a formed member, e.g., a metal member that is bent to a desired shape, e.g., a U-shape. The formed member may be attached to the polyurethane body by heating, pressing, mechanical, chemical, molding and/or any other suitable method/arrangement. Referring back to the figures, as shown in FIGS. 11A to 11B, angle 15 may form an upward U-shape. Angle 15 may extend the entire length of side edge portions 14, 16. Side edge portions 14, 16 may be configured for mounting vibratory screen 10 in a vibratory screening machine, as is well known.

Figure 10A:
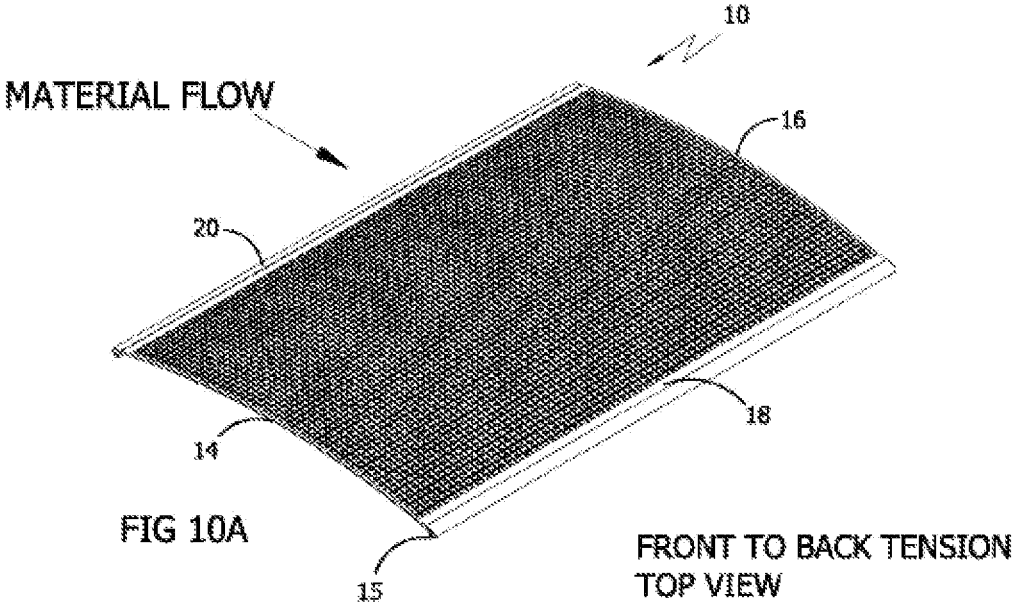
FIG. 10A is a top isometric view of a vibratory screen according to an exemplary embodiment of the present invention.
Figure 10B:
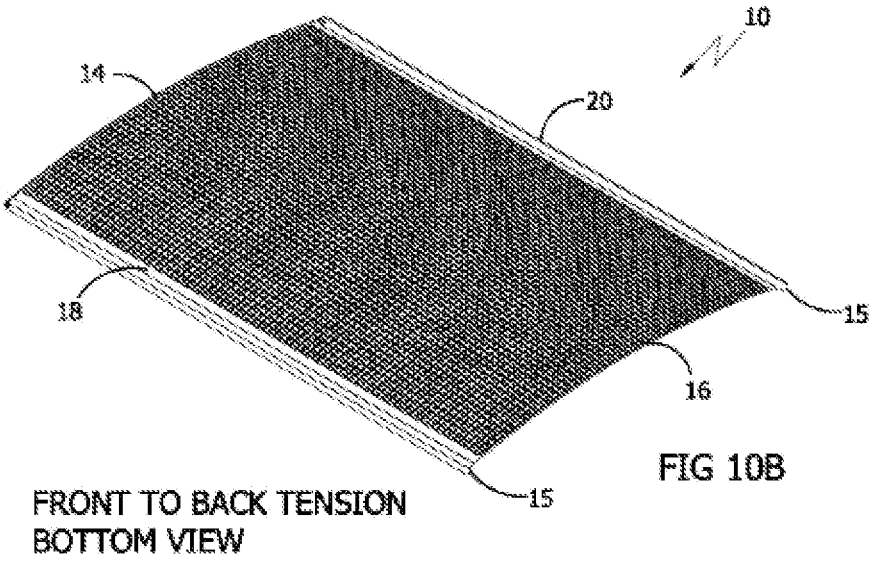
FIG. 10B is a bottom isometric view of the screen shown in FIG. 10A.

Body 12 also includes a lower edge portion 18 and an upper edge portion 20 which, in combination with side edge portions 14, 16, define an outer border of the screen 10. In certain embodiments, angle 15 may be included in upper edge portion 20 and lower edge portion 18. See, e.g., FIGS. 10A to 10B. In such embodiments, angle 15 may extend the entire length of upper edge portion 20 and lower edge portion 18. In example embodiments, upper edge portion 20 and lower edge portion 18 may be configured for mounting on a vibratory screen 1010 designed for mounting screens front to back. See, e.g., FIG. 13. Body 12 further includes an upper surface 22 and a lower surface 24 and includes first members 101 and second members 102 forming screen openings 26. Body 12 may further include third members 203, fourth members 204, fifth members 305 and sixth members 306. Body 12 may include various configurations of third members 203, fourth members 204, fifth members 305 and/or sixth members 306. The third members 203, fourth members 204, fifth members 305 and/or sixth members 306 may or may not include reinforcement members 50 and are generally configured to provide support to screen openings 26 formed by first and second members 101, 102. Body 12 may include first members 101 and second members 102 without third members 203, fourth members 204, fifth members 305 and/or sixth members 306. The first and/or second members 101, 102 may be configured to include reinforcement members 50. In certain embodiments, reinforcement rods 1050 may be incorporated into members running parallel to the edge portions of the screen having the vibratory machine attachment arrangements (e.g., the edges having the U-shaped structural members discussed herein). See, e.g., FIGS. 12 and 12A. Reinforcement rods 1050 provide stability to screen 10 by preventing the side edge portions, e.g., side edge portions 14, 16 shown in FIGS. 10A, 10B, 11A, 11B, 12 and 12A, from deforming and/or hourglassing. Reinforcement rods do not run perpendicular to the edge portions of the screen having the vibratory machine attachment arrangements as they are substantially rigid, provided for structural support and would generally restrict significant movement or deflection of the screen assembly when a force is applied to the edge portions that interface the vibratory screening machine tensioning members. In an exemplary embodiment, reinforcement rods 1050 may be integrated (including by molding integrally) with fourth members 204 and/or sixth members 306. Reinforcement rods 1050 may be made of plastic, metal, polymer or any other suitable material with the necessary structural properties.

First and second members 101, 102 form a first integrally molded grid structure 100 that defines screen openings 26. Third and fourth members 203, 204 may form a second integrally molded grid structure 200. Reinforcement rods 1050 may be integrally molded into fourth members 204. Fifth and sixth members may form a third integrally molded grid structure 300. Reinforcement rods 1050 may be integrally molded into sixth members 306. As shown in the exemplary embodiment depicted in FIGS. 1, 2, 3, 4 and 5, grid structures 200 and 300 include bi-directional integrally molded reinforcement members forming support grids within the members. Because of the properties of the reinforcement members 50, further discussed herein, and their configuration into a bi-directional grid structure, the members in which the reinforcement members 50 are embedded have a relatively small size and provide for increased open screening area. The grid structures provide screen strength, support for openings 26 during vibratory loading and significantly increase open screening area. Although second and third grid structures are discussed herein, fewer or additional grid structures may be provided.

First members 101 may be substantially parallel to each other and extend transversely between side edge portions 14, 16. The second members 102 may be substantially parallel to each other and extend transversely between the lower edge portion 18 and the upper edge portion 20. Second members 102 may have a thickness greater than the first members to provide additional structural support to screen openings 26.

Figure 9:
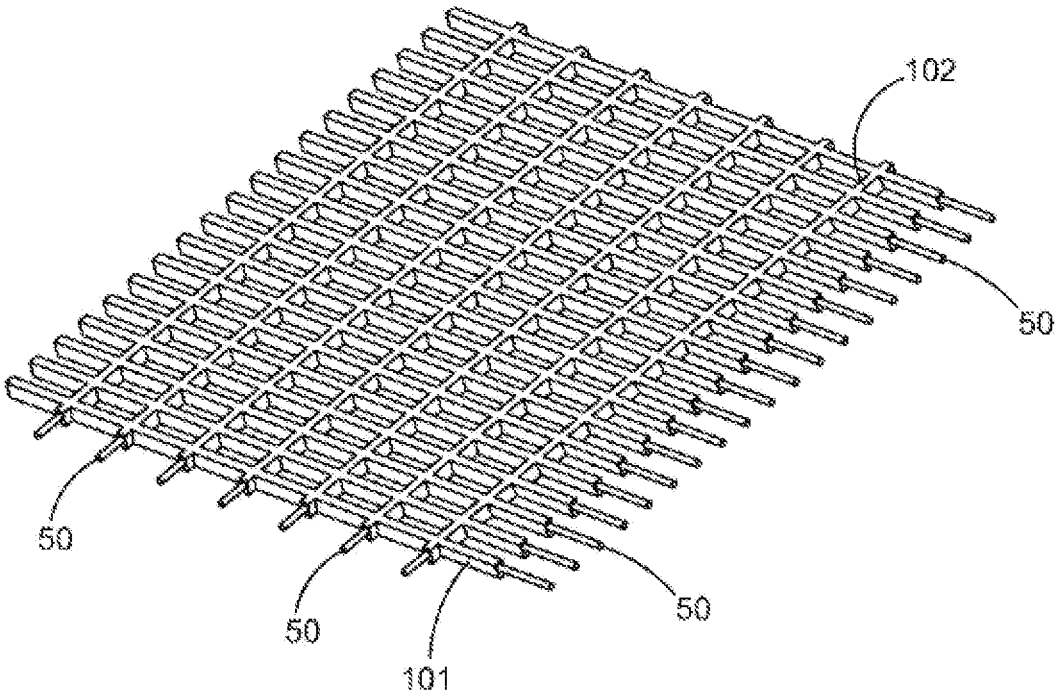
FIG. 9 is an enlarged isometric view of a portion of a vibratory screen according to an exemplary embodiment of the present invention having reinforcement members integral with first and second members forming screen openings.

First members 101 and/or second members 102 may include reinforcement members 50 and may or may not be supported by additional support members or support grid structures. See, e.g., FIGS. 6 and 9. As shown in FIG. 9, body 12 has first and second members 101, 102 with bi-directional reinforcement members 50 molded integrally therewith. The first members include reinforcement members molded integrally therewith, the reinforcement members having a thickness in the range of about 0.006 inches to about 0.015 inches. The second members include reinforcement members molded integrally therewith, the reinforcement members having a thickness in the range of about 0.015 inches to about 0.040 inches. Such configurations may be beneficial for screening applications requiring screens with larger screen openings.

In certain embodiments, reinforcement rods 1050 may be incorporated into at least one of the fourth and sixth members, 204 and 306 respectively and run from edges 14 to 16. See., e.g. FIGS. 12 and 12A. Reinforcement rods 1050 provide stability and prevent hourglassing or other deformation of the screen along the edges of the screen without the U-shape channels, i.e., edges 14 and 16. These embodiments may incorporate reinforcement members 50 in first, second, third, fourth, fifth and/or sixth members 101, 102, 203, 204, 305, 306. Reinforcement members 50 may be incorporated into all or a portion of first, second, third, fourth, fifth and/or sixth members 101, 102, 203, 204, 305, 306. Reinforcement members 50 provide screen properties as discussed herein.

Figures 4, 4A:
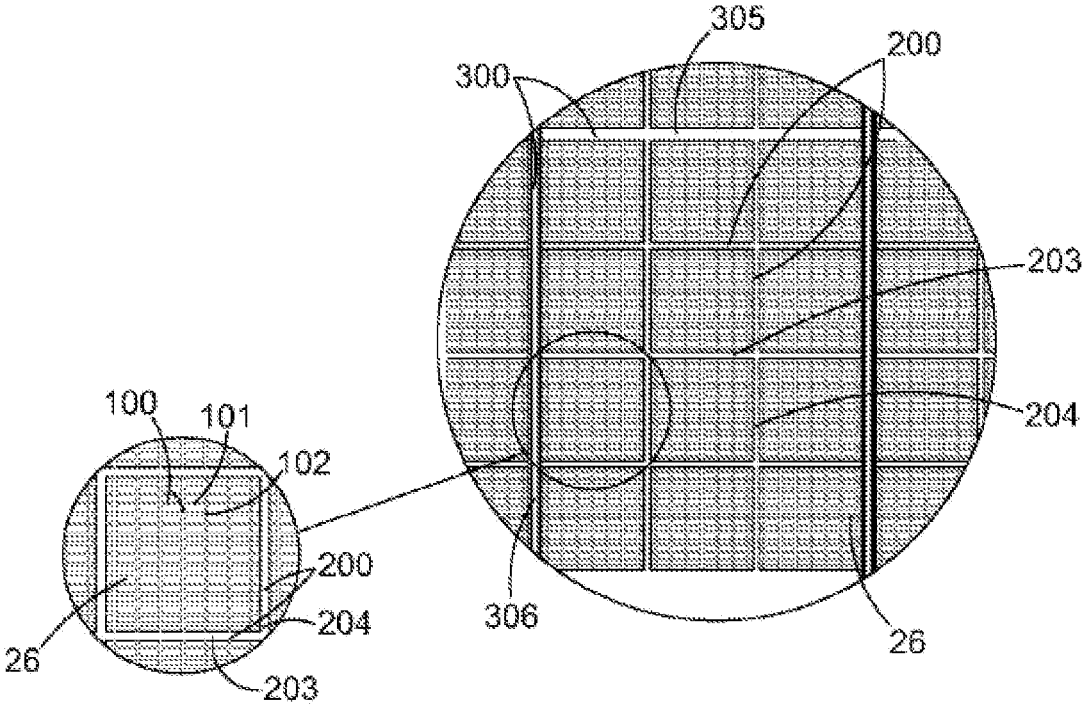
FIG. 4 is a plan view of a portion of the screen shown in FIG. 1.
FIG. 4A is an enlarged plan view of a portion of the screen shown in FIG. 4.
Figures 5, 5A:
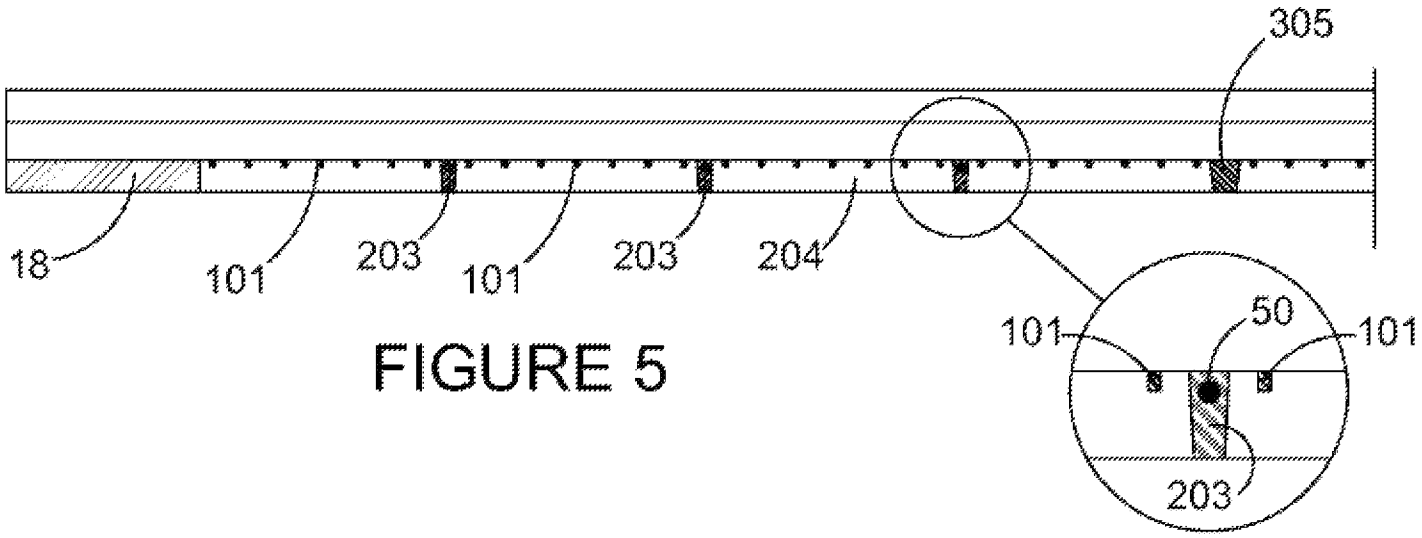
FIG. 5 is a fragmentary cross sectional view taken substantially along line 5-5 of FIG. 1.
FIG. 5A is an enlarged fragmentary cross sectional view of a portion of the screen shown in FIG. 5.

As shown in FIG. 4, the screen openings 26 are elongated with a greater length dimension along sides and between ends thereof than width dimensions between the sides and their length dimensions extending in a direction transverse to the side edge portions 14, 16. Screen openings 26 may be about 0.044 mm to about 4 mm in width (i.e., between the inner surfaces of adjacent first members 101) and about 0.044 mm to about 60 mm in length (i.e., between inner surfaces of adjacent second members 102). Screen openings 26 may have a variety of different shapes. For example, the screen openings 26 may have a rectangular shape, a square shape, circular shape and/or any other shape that may be formed by the first and second members 101, 102. The overall dimensions of screen 10 may be about 1.2 meters times 1.6 meters, or any other desired size. All of the dimensions set forth herein are by way of example and not of limitation.

Figure 6:
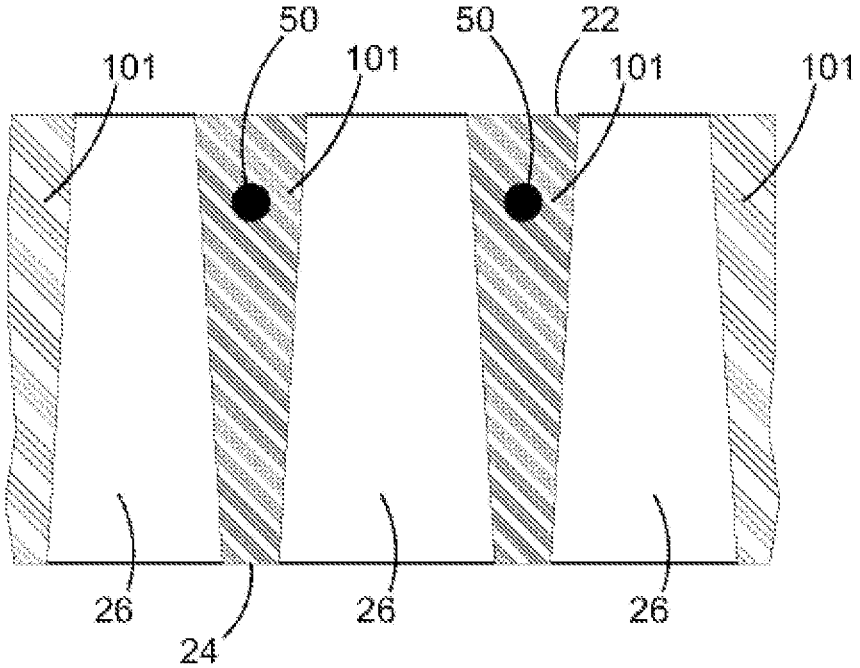
FIG. 6 is an enlarged fragmentary cross sectional view similar to the view taken substantially along line 5-5 of FIG. 5, but showing only a cross section configuration of a modified shape of first members having reinforcement members.
Figure 7:
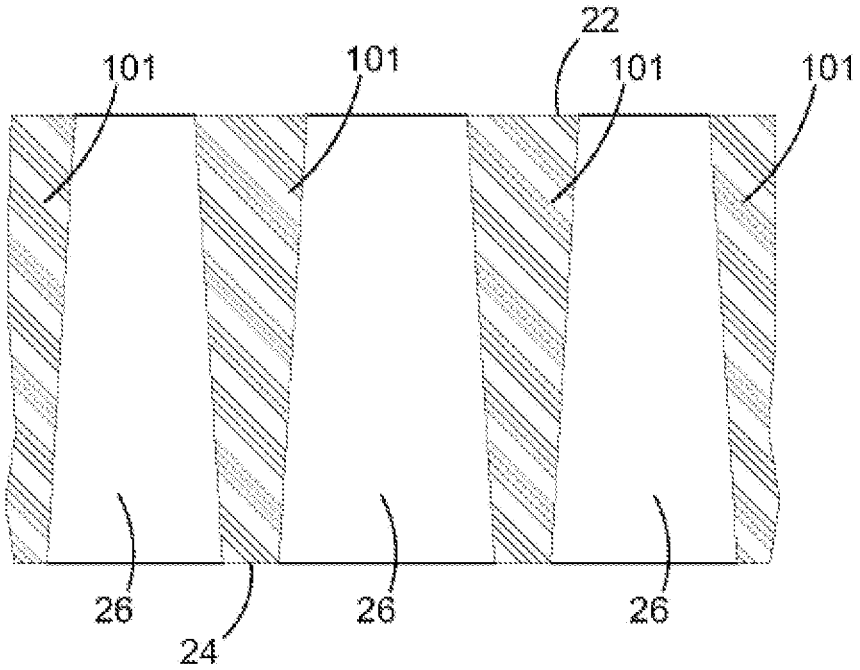
FIG. 7 is a view similar to FIG. 6 but showing first members without reinforcement members.

Screen openings 26 may diverge downwardly between the upper surface 22 and the lower surface 24 and the first members 101 may be substantially in the shape of inverted trapezoids. See, e.g., FIGS. 6 and 7. This general shape of the first members 101 prevents blinding in screens 10. As shown in FIG. 6, first members 101 include reinforcement members 50. As shown in FIG. 7, first members 101 do not include reinforcement members 50.

Screens with the various screen opening sizes and support configurations described herein have a relatively large open screening areas. Open screening areas may range, for example, from between about 40 percent to about 46 percent. As further discussed herein, the relatively large open screening areas may be obtained through the placement of bi-directional reinforcement members 50 in cross members (e.g., members 203, 204) as described in the various embodiments herein. The reinforcement members significantly decrease the size of both of the bi-directional support cross members and allow for a thinner screen members, 101, 102 forming the screen openings 26. The grid work of support members and reinforcement members provide for a structurally sound screen that maintains the necessary screen openings during vibratory operation.

Third and fourth members 203, 204 may have a thickness greater than the first and second members 101, 102. The greater thickness may provide additional structural support to first and second members 101, 102. The third members 203 may be substantially parallel and extend transversely between the side edge portions 14, 16 and may have multiple first members 101 therebetween. The fourth members 204 may be substantially parallel and extend transversely between the lower edge portion 18 and the upper edge portion 20 and having multiple second members 102 therebetween. Fourth members 204 may have reinforcement rods 1050 integrally molded therein. Reinforcement members 50 may be molded integrally with the third and fourth members 203, 204. See, e.g., FIGS. 3A, 5A. Third and fourth members 203, 204 may be configured to have a minimal thickness through inclusion of reinforcement members 50, while providing the necessary structural support to maintain the screen openings 26 formed by first and second members 101, 102 during vibratory screening applications. The bi-direction support system provided by reinforced third and fourth members 203, 204 greatly reduces the thickness of the support members and provides for increased open screening area and overall screen efficiencies. Incorporation of reinforcement rods 1050 into fourth members 204 may adds stability to screen 10 and prevents hourglassing, i.e., deflection inwardly of side edges 14, 16 to give the screen a general hourglass type shape.

Fifth members 305 and sixth members 306 may be included in body 12. Fifth and sixth members may have a thickness greater than the third and fourth members and may have a portion 310 extending downwardly away from the lower surface of the body. The greater thickness and portion extending downwardly may to provide additional structural support to first and second members 101, 102. The sixth members 306 may include a portion 320 extending upwardly away from the upper surface of the body. Portion 320 may be substantially triangular in cross-section with apexes projecting away from the upper surface 22 of body 12. Sixth members 306 are shown in FIG. 2 with portion 320 extending upwardly away from the upper surface of body 12 and acting as flow guides. Sixth members 306 may have reinforcement rods 1050 integrally molded therein. The fifth members 305 may be substantially parallel and extending transversely between the side edge portions 14, 16 and have multiple third members 203 therebetween. The sixth members 306 may be substantially parallel and extending transversely between the lower edge portion 18 and the upper edge portion 20 and have multiple fourth members 204 therebetween. Reinforcement members 50 may be molded integrally with fifth and sixth members 305, 306. Fifth and sixth members 305, 306 may be provided for additional support to screen openings 26 and may be configured to have a minimal thickness through inclusion of reinforcement members 50, while providing the necessary structural support to maintain screen openings 26 during vibratory screening applications. The bi-direction support system provided by reinforced fifth and sixth members 305, 306 greatly reduces the thickness of the support members and provides for increased open screening area and overall screen efficiencies. Incorporation of reinforcement rods 1050 into sixth members 306 adds stability to screen 10 and prevents hourglassing.

Figures 12, 12A:
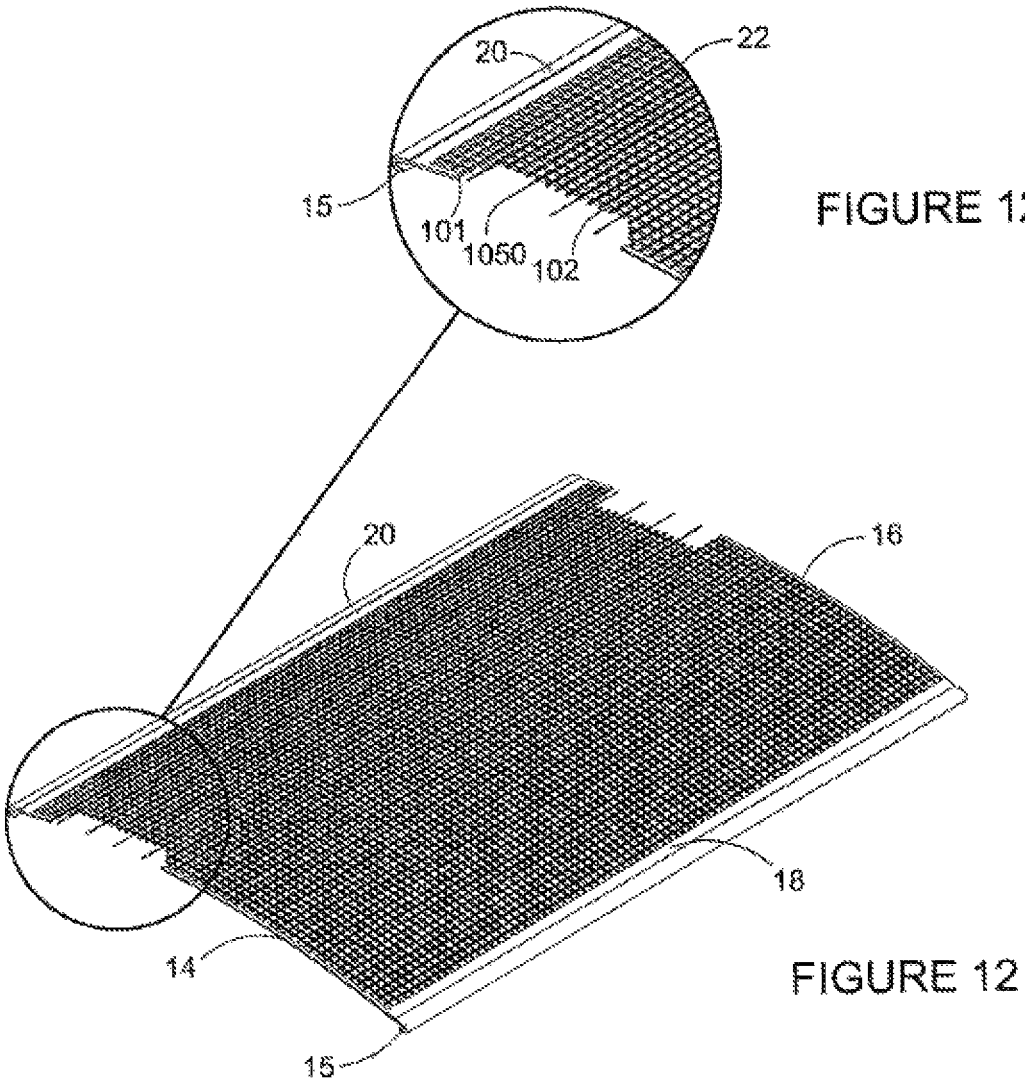
FIG. 12 is a top isometric view of a vibratory screen with a portion of the screen removed showing reinforcement rods according to an exemplary embodiment of the present invention.
FIG. 12A is an enlarged top isometric view of a portion of the screen shown in FIG. 12.

FIG. 1A shows an exemplary embodiment of the present inventions having first and second members 101, 102 forming screen openings 26 and members 203, 204 forming a support grid structure for openings 26. As shown in FIG. 1A, screen 10 does not include fifth and sixth members 305, 306. FIGS. 12 and 12A show another exemplary embodiment of the present invention having reinforcement rods 1050 integrally molded therein. As shown in FIGS. 12 and 12A, reinforcement rods 1050 are integrally molded into fourth members 204. Reinforcement rods 1050 may also be integrally molded into sixth members 306 or other members running parallel to members 204 and 306.

In use, the vibratory screen 10 is mounted on a vibratory screening machine 30 (FIG. 8) in the well known manner. More specifically, it is mounted on the screen deck bed 31 which is mounted on the frame (not shown) of the machine. The screen deck bed 31 includes spaced substantially parallel frame members 32 secured to each other by spaced substantially parallel cross frame members (not shown). Extending transversely between the cross frame members are a plurality of substantially parallel stringers 33 which mount channel rubbers 34. Mounted on parallel frame members 32 are channel-shaped draw bars 35 having lower portions 36 which are received within side edge portions 14, 16. Draw bolts 37 draw bars 35 apart to thereby tension vibratory screen 10 with the required force. The foregoing type of screen deck bed is well known in the art. Screen 10 may be mounted to other vibratory screening machines and side edge portions 14, 16 may be configured in other shapes to accommodate different vibratory screening machines.

Figure 13:
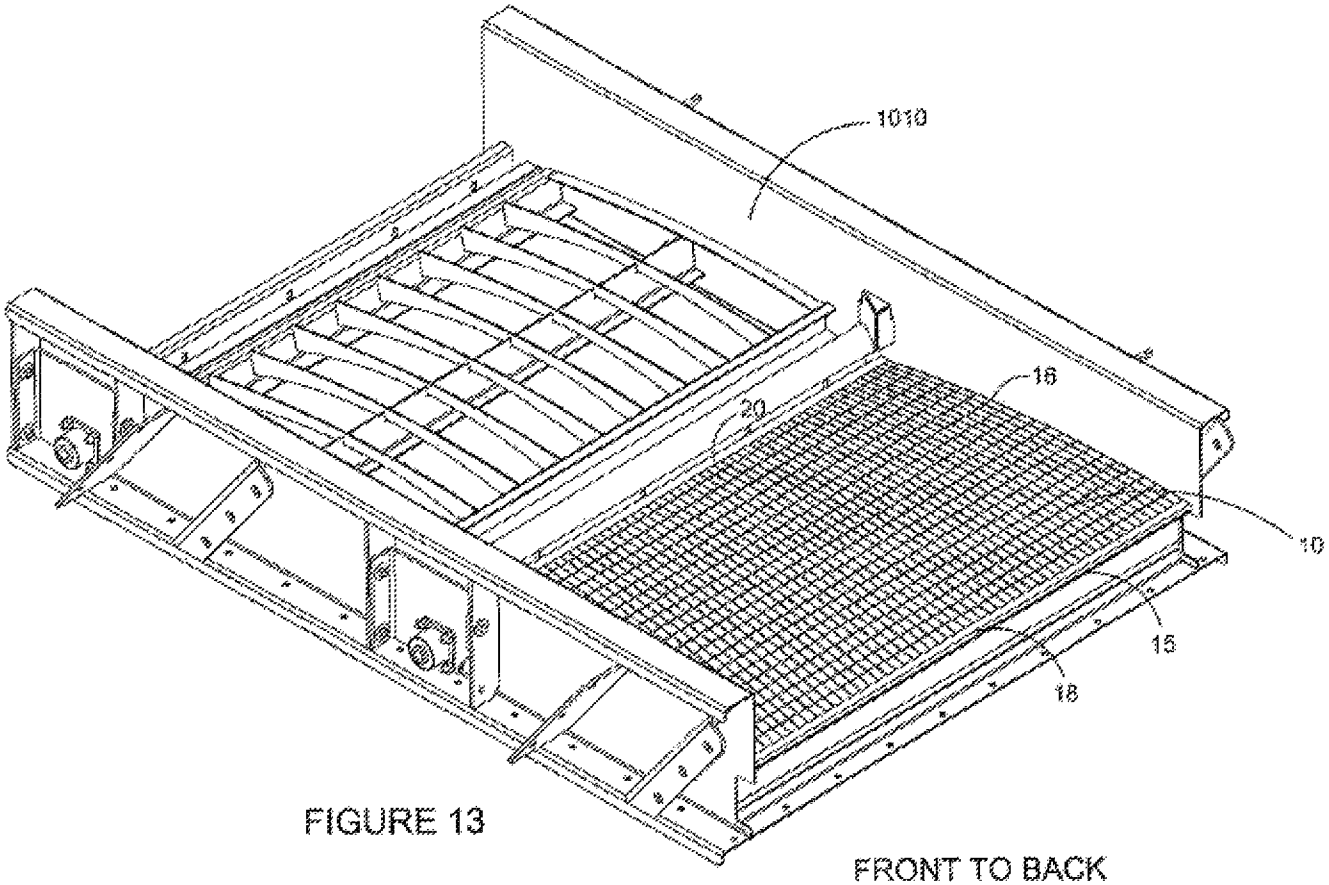
FIG. 13 is an isometric view of a portion of a vibratory screening machine having a vibratory screen installed thereon according to an exemplary embodiment of the present invention.

The embodiment shown in FIG. 13 is mounted front to back on vibratory screening machine 1010. In this embodiment, angle 15 is included in upper edge 20 and lower edge 18 and is below top surface 22. This embodiment has tension applied from underneath the screen rather than above and the tension is applied from front to back.

Figure 14:
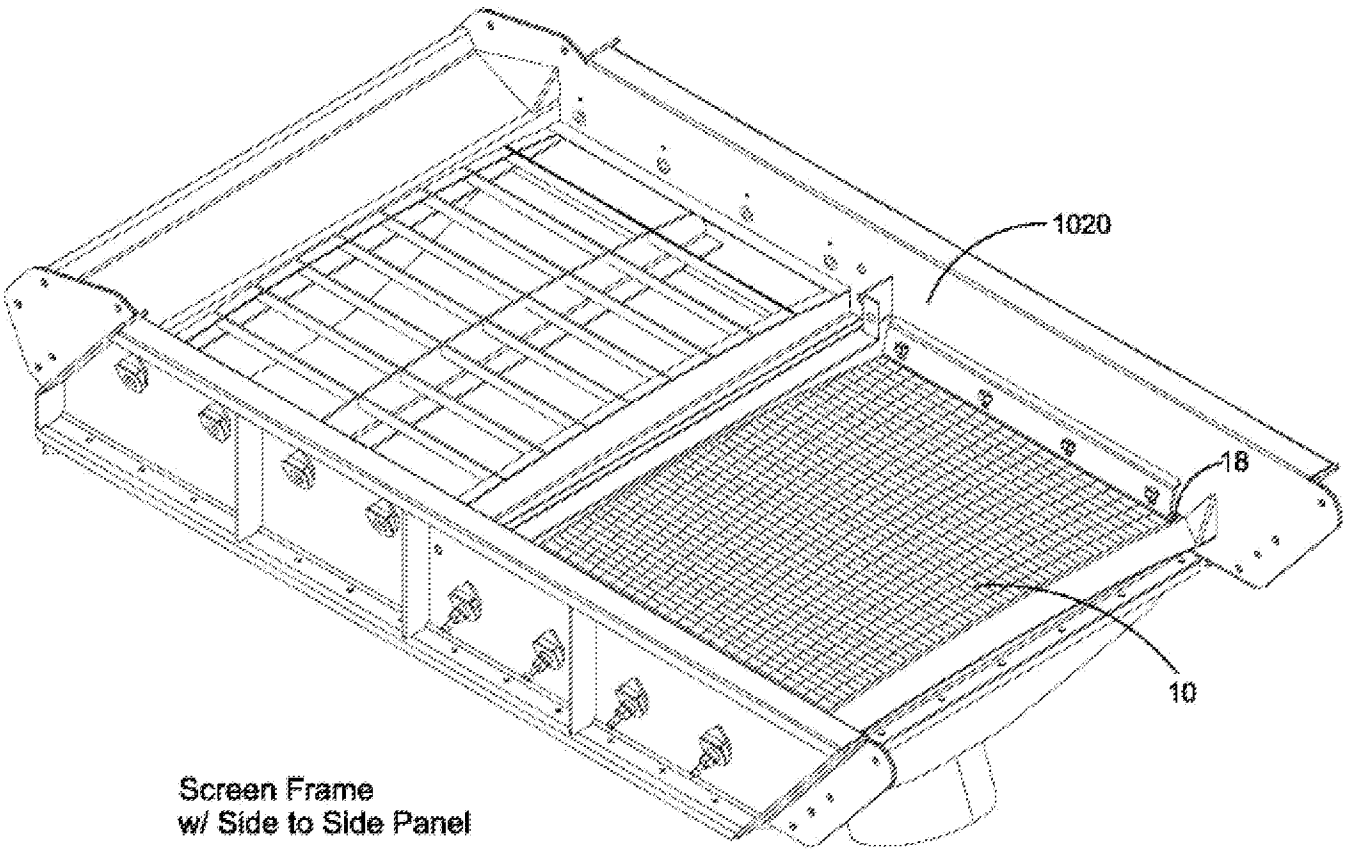
FIG. 14 is an isometric view of a portion of a vibratory screening machine having a vibratory screen installed thereon according to an exemplary embodiment of the present invention.

FIG. 14 shows an embodiment having angle 15 included in side edges 18, 20. This embodiment also has tension applied from above the screen and from side to side.

Figure 8:
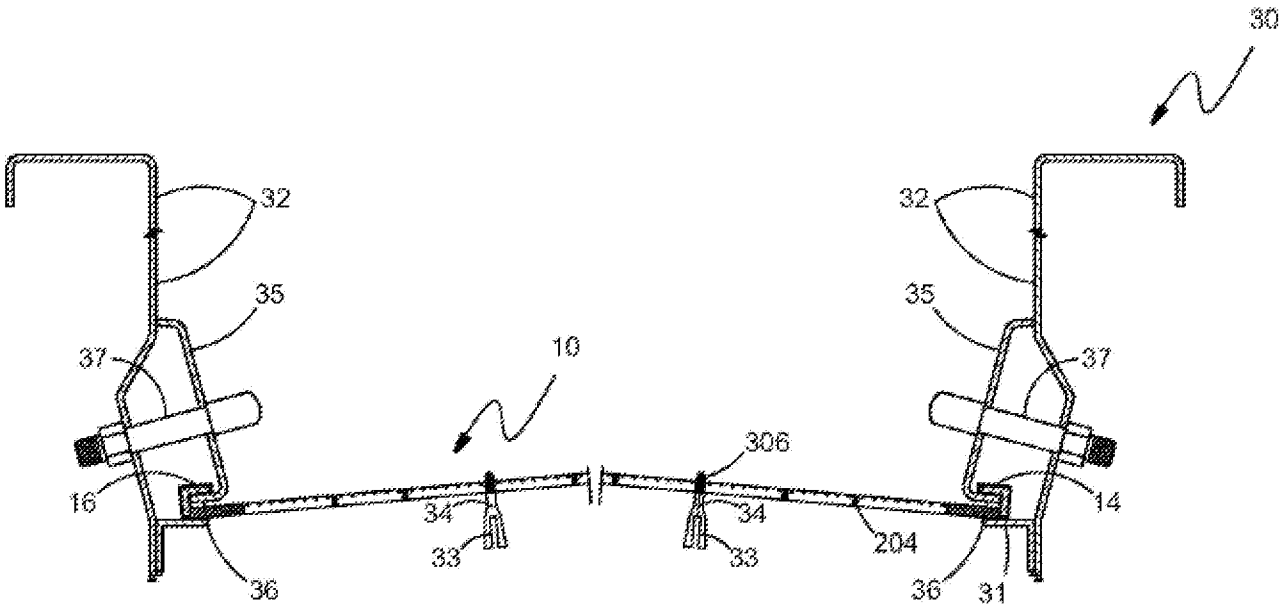
FIG. 8 is a fragmentary cross sectional view showing the manner in which the improved screen of FIG. 1 is mounted in a vibratory screening machine.

Reinforcement members 50 as described herein may be an aramid fiber (or individual filaments thereof), a naturally occurring fiber or others material having relatively large tensile strengths with relatively small cross sectional areas. When an aramid fiber is used as reinforcement fiber 50 it may be aramid fibers that are commercially obtainable under the trademark KEVLAR of the DuPont Company and further identified by the designation KEVLAR 29. The reinforcement members 50 may also be at least one of aramid fibers that are commercially obtainable under the trademarks TWARON, SULFRON, TEIJINCONEX, and TECHNORA of the Teijin Company. In addition, the aramid fibers may be twisted or woven multistrand so that they act as nature of wicks to absorb the polyurethane which is molded around them to thereby provide an extremely good bond therewith. The twisted or a woven multistrand fibers may be about 55 denier to about 2840 denier, preferably approximately 1500 denier. The flexibility of the aramid fibers provides a flexible reinforcement system for the molded polyurethane which is able to return to its original molded shape after the necessary bending and flexing that occurs during handling and installation into the vibratory frame member 32. Furthermore, flexible aramid fibers permit the flexible polyurethane screen to be flexed without harm into an arcuate condition and tensioned as shown in FIGS. 8, 13 and 14. Reinforcement members 50 may be tensioned before polyurethane is molded around them. Various configurations of reinforcement members 50 may be provided in any one of the first, second, third, fourth, fifth and sixth members 101, 102, 203, 204, 305, 306. Each member may include zero, one or more reinforcement members 50 and the reinforcement members 50 may be of different sizes and materials. Reinforcement members 50 may be located in the bottom halves of the members so as not to be exposed relatively early as the upper surface of the screen wears.

During operation, first members 101 will vibrate to enhance the screening action. In this regard, it is to be noted that because first members 101 are flexible and relatively thin they will provide a relatively high amplitude of desirable vibration. The reason the first members 101 can be made relatively thin, creating screen openings described herein, is because of a support framework of bi-directional support members and reinforcement members, as described herein, having relatively large tensile strengths with relatively small cross sectional areas. The making of the support members and the first members 101 relatively thin results in the screen having a greater percentage of open area, which, in turn, increases its capacity.

Figure 15:
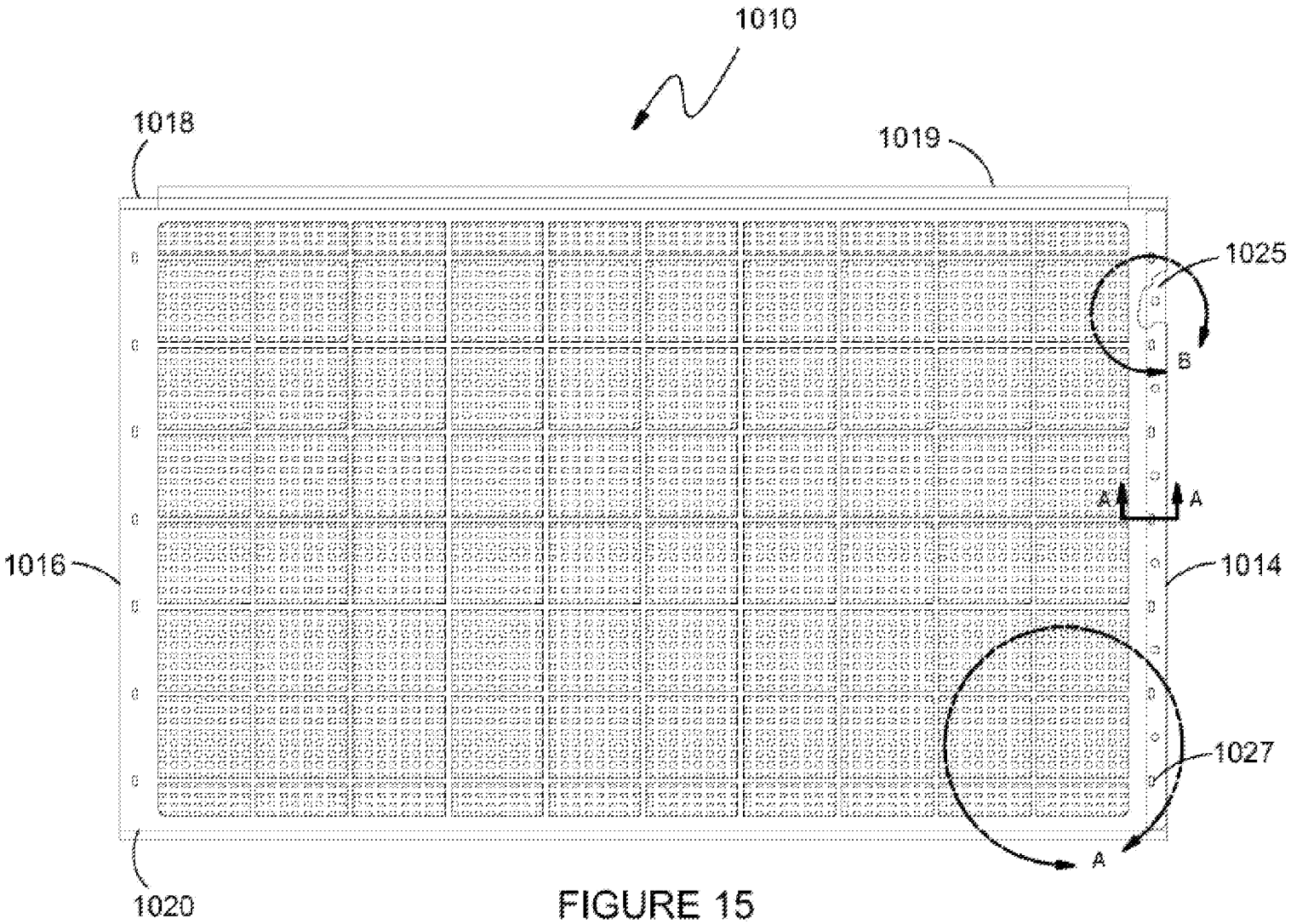
FIG. 15 is a top view of a screen for an attrition screening device, according to an exemplary embodiment of the present invention.
Figure 20:
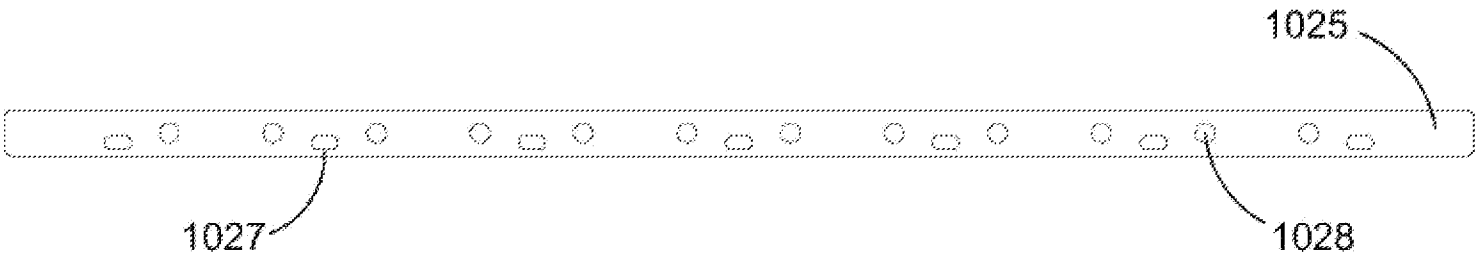
FIG. 20 is a top view of a tension strip, according to an exemplary embodiment of the present invention.

All of the dimensions set forth herein are by way of example and not of limitation. FIG. 15 shows a top view of a screen 1010, which is configured for attachment to a support deck 1011 and for use in an attrition screening device such as a sifter. The screen includes a body of molded polyurethane having side edge portions 1014, 1016. The screen 1010 also includes a lower edge portion 1018 and an upper edge portion 1020 which, in combination with side edge portions 1014, 1016, define an outer border of the screen 1010. In some embodiments, side edge portions 1014, 1016 may include multiple grommets 1027 spaced evenly from each other. See, e.g., FIGS. 15 and 16B. Side edge portions 1014, 1016 with grommets 1027 may be configured for mounting screens 1010 to a support deck 1011 in an attrition screening device such as a sifter using a plurality of clips 1060. See, e.g., FIG. 17 and FIG. 17A. The grommets 1027 are shown as oval shaped, but may also be circular, rectangular, or any other shape suitable for securing the screens 1010 to the support deck 1011. In an exemplary embodiment, the multiple grommets 1027 are spaced evenly from each other. In an alternative embodiment, the multiple grommets 1027 may be spaced at varying distances from each other. Side edge portions 1014, 1016 may each include a tension strip 1025, such as shown in FIGS. 16A and 20. The tension strip 1025 may be a formed member, e.g., a metal member or other suitable structural member that may extend the entire length of side edge portions 1014, 1016, or may extend only a portion of the length of the side edge portions 1014, 1016. The tension strip 1025 may be secured to or within the polyurethane body of the screen 1010. The tension strip 1025 may be a cast-in tension strip 1025 and formed inside the side edge portions 1014, 1016 of the screen 1010 by heating, pressing, mechanical, chemical, molding and/or any other suitable method/arrangement.

In some embodiments, side edge portions 1014, 1016 may include multiple apertures 1028 spaced evenly from each other. See, e.g., FIGS. 15, 16C, and 20. Side edge portions 1014, 1016 with apertures 1028 may be configured to be filled up with polyurethane to hold or suspend the cast-in tension strip 1025 in place within the side edge portions 1014, 1016 of the screen 1010. The apertures 1028 are shown as circular shaped, but may also be oval, rectangular, or any other shape suitable for holding or suspending the cast-in tension strip 1025 in place within the side edge portions 1014, 1016 of the screen 1010. In an exemplary embodiment, the multiple apertures 1028 are spaced evenly from each other. In an alternative embodiment, the multiple apertures 1028 may be spaced at varying distances from each other. In an exemplary embodiment, as shown in FIG. 20, the cast-in tension strip 1025 may be formed with openings forming the grommets 1027 or apertures 1028 on the side edge portions 1014, 1016. See FIG. 20. The cast-in tension strip 25 is configured to distribute loads evenly across the screen 1010. Side edge portions 1014, 1016 may also be formed without tension strips 1025 and/or may include other structural members. FIG. 16C is an enlarged fragmentary cross sectional view of a portion of the screen 1010 showing both the side edge portion 1014 as well as the cast-in tension strip 1025 located inside the side edge portion 1014.

Figures 17, 17A:
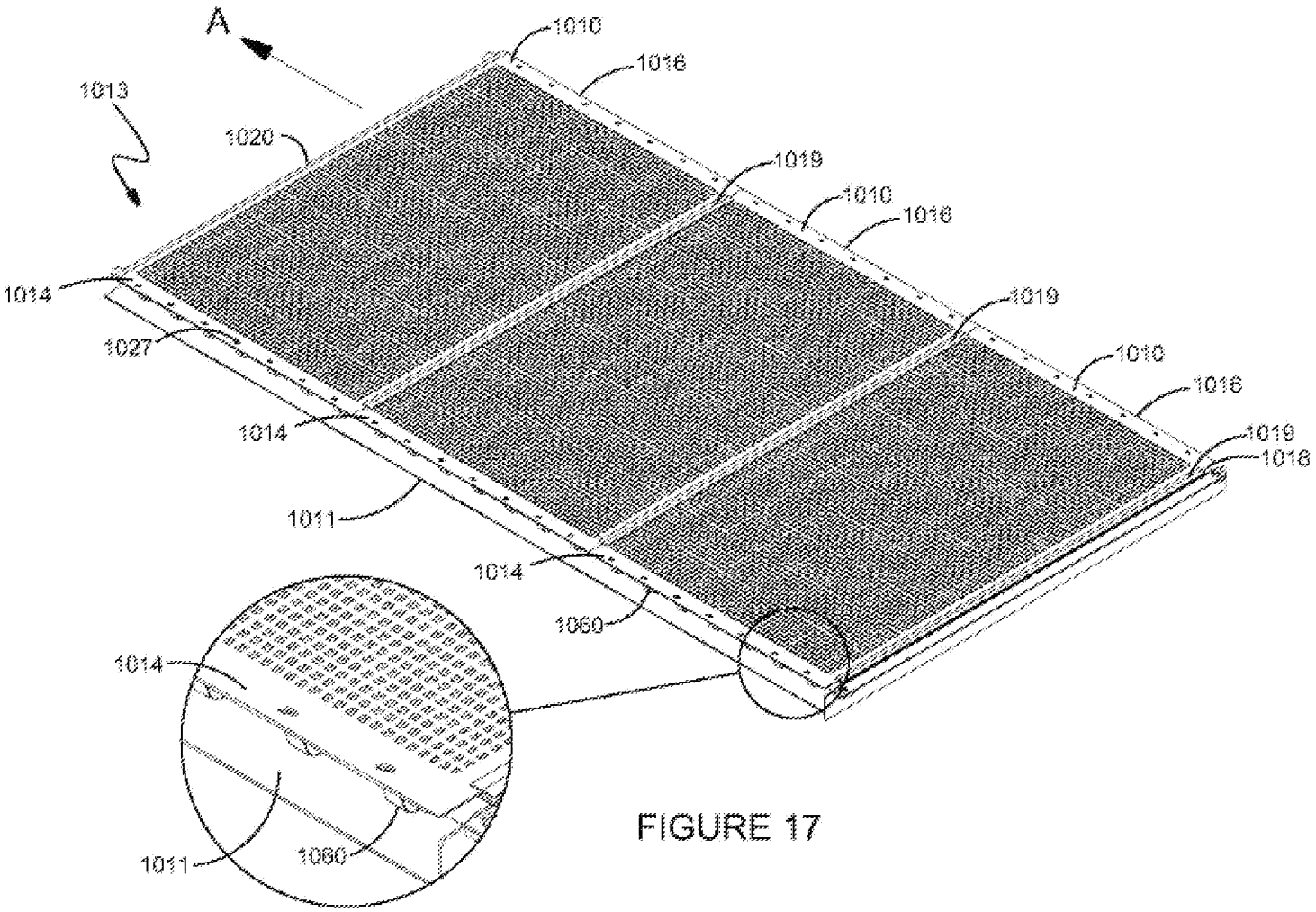
FIG. 17 is a top isometric view of a screen deck assembly including three screens and a support deck, according to an exemplary embodiment of the present invention.
FIG. 17A is an enlarged isometric view of a portion of the screen deck assembly shown in FIG. 17.
Figure 18:
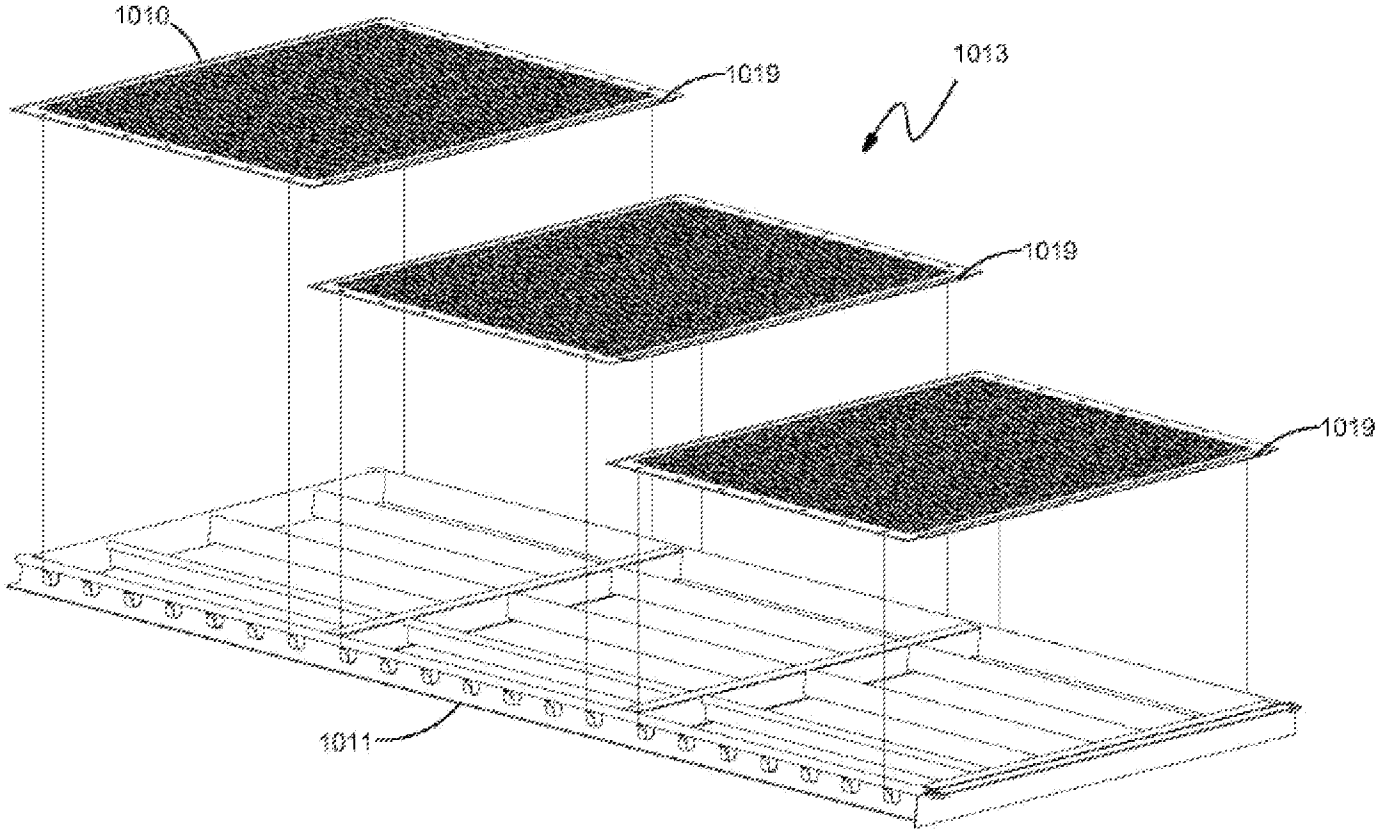
FIG. 18 is an exploded isometric view of the screen deck assembly shown in FIG. 17.

Referring now to FIG. 17 and FIG. 18, an embodiment of a screen deck assembly 1013 for an attrition screening device such as a sifter is shown. FIG. 17 shows a top isometric view of screen deck assembly 1013 including three screen sections and a support deck 1011. FIG. 18 shows an exploded isometric view of the same screen deck assembly 1013. The support deck 1011 may be configured in several ways. In an exemplary embodiment, the support deck 1011 may be a single unit with three equally-sized square or rectangular shaped screen sections adjacent to each other, each screen section configured for attachment of screens 1010. In an alternative embodiment, the support deck 1011 may have more or less screen sections configured for attachment of screens 1010, and may be provided in various shapes for use in various screening machines used for separation of materials. The support deck 1011 may have a plurality of parallel support members or cross-members extending across each screen section in a direction substantially parallel to the side edge portions 1014, 1016. In an alternative embodiment, the support deck 1011 may have a plurality of parallel support members or cross-members extending across each screen section in a direction substantially perpendicular to the side edge portions 1014, 1016. In an exemplary embodiment, each screen section of the support deck 1011 may have three parallel support members or cross-members. In alternative embodiments, each screen section of the support deck 1011 may have more or less parallel support members or cross-members.

Each screen section of the support deck 1011 may be configured for attachment of one screen 1010, respectively. In an exemplary embodiment, each screen 1010 may be rectangular-shaped. In an alternative embodiment, each screen 1010 may be square-shaped or any other shape suitable for attachment to a support deck 1011. This configuration allows for easy replacement of one screen 1010 from a screen section of the screen deck assembly 1013 without replacing all three screens 1010 at once. In an embodiment, the screens 10 may be placed next to each other so that some overlap exists between the screens 1010. To accomplish this overlap between the screens 1010, a first screen 1010 may include an overlap sealing member 1019 attached to and extending away from an outer border of the lower edge portion 1018 of the screen, as shown in FIGS. 17 and 18. The overlap sealing member 1019 may then be attached to the upper edge portion 1020 of an adjacent second screen 1010 placed next to the first screen 1010 with the attached overlap sealing member 1019. This overlap sealing member 1019 may be configured to assist in placing the screens 1010 next to each other in such a manner as to allow the first screen 1010 to overlap the adjacent second screen 1010 and form a seal thereto or otherwise secure itself thereto. In an embodiment, only one screen may contain an overlap sealing member 1019 such that two out of three screens 1010 overlap with each other. In an alternative embodiment, two screens 1010 may contain overlap sealing members 1019 such that all three screens 1010 overlap with each other. The overlap sealing members 1019 may be attached to the screens 1010 or formed as part of the screens 1010.

Figures 19, 19A, 19B:
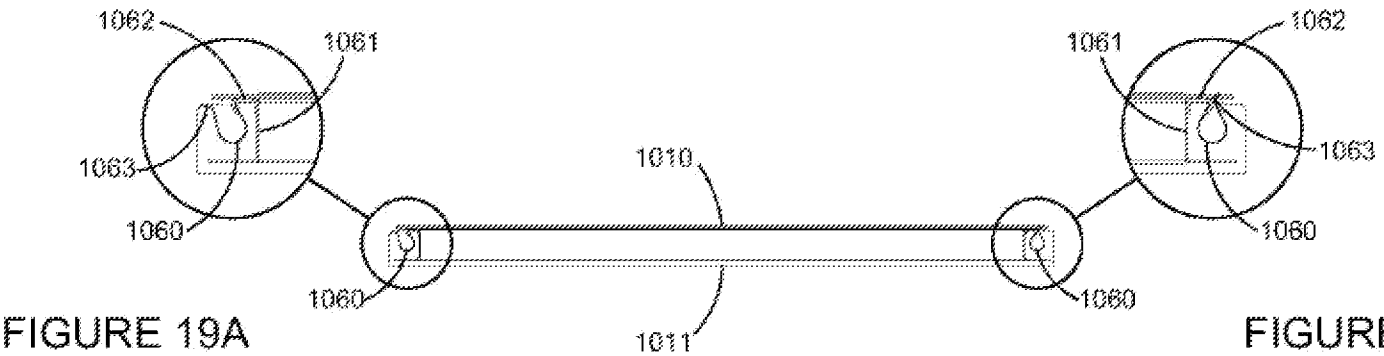
FIG. 19 is an end view of a screen deck assembly with attached spring clips, according to an exemplary embodiment of the present invention.
FIG. 19A is an enlarged end view of the screen deck assembly shown in FIG. 19 with attached spring clips not mounted to a screen.
FIG. 19B is an enlarged end view of the screen deck assembly shown in FIG. 19 with attached spring clips mounted to the screen.

Each screen 1010 is mounted to and/or tensioned across the support deck 1011 using a plurality of spring clips 1060. See, e.g., FIG. 17A. As shown in FIG. 19, the spring clips 1060 are generally U-shaped with a hook-shaped portion 1061 projecting from one end thereof that is seated within a similarly shaped flange 1062 extending around the upper edge of the support deck 1011. A tang 1063 extends from the opposite end of the U-shaped spring clip 1060. See FIGS. 19A and 19B. The tang 1063 may be inserted through the grommet 1027 at the perimeter of the screen 1010 to mount the screen 1010 onto the support deck 1011. See FIG. 19B. The end of the U-shaped spring clip 1060 may then be slightly compressed together to thereby tension the screen 1010 on the support deck 1011. Although spring clips 1060 are disclosed in this particular embodiment, other methods may also be used for attaching the screens 1010 to the support deck 1011, including but not limited to fasteners, adhesives, drawbars, and/or other mechanical attachment systems and combinations thereof, including securing the screen 1010 on one side to the support deck 1011 and tensioning the opposing side of the screen 1010 with a fastener, including a removable spring clip 1060.

Once the screens 1010 are secured to the support deck 1011, the screen deck assembly 1013 is then inserted into an attrition screening device such as a sifter, disclosed in U.S. Pat. Nos. 6,070,736, 8,113,358, 8,522,981, and U.S. Patent Pub. No. 2011/0036759, in the direction shown by arrow A in FIG. 17. In an exemplary embodiment of the screen deck assembly 1013 including three screens 1010, the screen deck assembly 1013 is inserted into the attrition screening device with the upper edge portion 1020 of a first screen 1010 being inserted first, followed by a second screen 1010 adjacent to the first screen 1010, and ending with the lower edge portion 1018 of a third screen 1010. Other orientations and configurations may be utilized, depending on the particular attrition screening device being utilized, for securing screen 1010 or screens 1010 to a support deck 1011 and inserting it into the attrition screening device.

In an exemplary embodiment, the screens 1010 for use in attrition screening devices such as sifters may include features disclosed and described herein for screens 10 used in vibratory screening machines. See, e.g., FIGS. 4, 4A, 5, 6, 7, and 9. For example, screens 1010 may include features described with regard to screens 10 such as the materials, shapes and/or configurations of the upper surface, lower surface, first members, second members, third members, fourth members, fifth members, sixth members, reinforcement members, and reinforcement rods. The third members, fourth members, fifth members and/or sixth members may or may not include reinforcement members and are generally configured to provide support to screen openings formed by first and second members. The screen 1010 may include first members and second members without third members, fourth members, fifth members and/or sixth members. The first and/or second members may be configured to include reinforcement members. In certain embodiments, reinforcement rods may be incorporated into members running parallel to the edge portions 1014, 1016 of the screen 1010. Reinforcement rods provide stability to screen 1010 by preventing unwanted deformations and/or hourglassing. In an exemplary embodiment, reinforcement rods may be integrated (including by molding integrally) with fourth members and/or sixth members. Reinforcement rods may be made of plastic, metal, polymer or any other suitable material with the necessary structural properties. In an embodiment of the present invention, screen 1010 may be pretensioned with structural members, which may be internal or external and then clamped or otherwise secured to a member of a frame or support deck 1011.

First and second members may form a first integrally molded grid structure that defines screen openings in the screen 1010. Third and fourth members may form a second integrally molded grid structure. Reinforcement rods may be integrally molded into fourth members. Fifth and sixth members may form a third integrally molded grid structure. Reinforcement rods may be integrally molded into sixth members. As shown in the exemplary embodiment depicted in FIGS. 1, 2, 3, 4 5, and 15, grid structures include bi-directional integrally molded reinforcement members forming support grids within the members. Although second and third grid structures are discussed herein, fewer or additional grid structures may be provided depending on the overall size and shape of the screen 1010 and support needed for the screen 1010.

First members may be substantially parallel to each other and extend transversely between side edge portions 1014, 1016. In this embodiment, the first members run perpendicular to the side edge portions 1014, 1016. The second members may be substantially parallel to each other and extend transversely between the lower edge portion 1018 and the upper edge portion 1020. In this embodiment, the second members run parallel to the side edge portions 1014, 1016. Second members may have a thickness greater than the first members to provide additional structural support to screen openings in the screen 1010. First members and/or second members may include reinforcement members and may or may not be supported by additional support members or support grid structures.

In certain embodiments, reinforcement rods may be incorporated into at least one of the fourth and sixth members, respectively, and run from edges 1014 to 1016 (or vice-versa). Reinforcement rods provide stability and prevent hourglassing or other deformation of the screen along the side edge portions 1014, 1016 of the screen 1010. These embodiments may incorporate reinforcement members in first, second, third, fourth, fifth and/or sixth members. Reinforcement members may be incorporated into all or a portion of first, second, third, fourth, fifth and/or sixth members.

Third and fourth members may have a thickness greater than the first and second members. The greater thickness may provide additional structural support to first and second members. The third members may be substantially parallel and extend transversely between the side edge portions 1014, 1016 and may have multiple first members therebetween. In this embodiment, the third members run perpendicular to the side edge portions 1014, 1016. The fourth members may be substantially parallel and extend transversely between the lower edge portion 1018 and the upper edge portion 1020 and may have multiple second members therebetween. In this embodiment, the fourth members run parallel to the side edge portions 1014, 1016. Fourth members may have reinforcement rods integrally molded therein. Reinforcement members may be molded integrally with the third and fourth members. Third and fourth members may be configured to have a minimal thickness through inclusion of reinforcement members, while providing the necessary structural support to maintain the screen openings in the screen 1010 formed by first and second members during sifter screening applications. The bi-direction support system provided by reinforced third and fourth members greatly reduces the thickness of the support members and provides for increased open screening area and overall screen efficiencies. Incorporation of reinforcement rods into fourth members may add stability to screen 1010 and prevents unwanted deformations and/or hourglassing of screen 1010.

Fifth members and sixth members may be included in the screens 1010. Fifth and sixth members may have a thickness greater than the third and fourth members and may have a portion extending downwardly away from the lower surface of the screen 1010. The greater thickness and portion extending downwardly may to provide additional structural support to first and second members. Sixth members may have reinforcement rods integrally molded therein. The fifth members may be substantially parallel and extend transversely between the side edge portions 1014, 1016 and have multiple third members therebetween. In this embodiment, the fifth members run perpendicular to the side edge portions 1014, 1016. The sixth members may be substantially parallel and extend transversely between the lower edge portion 1018 and the upper edge portion 1020 and have multiple fourth members therebetween. In this embodiment, the sixth members run parallel to the side edge portions 1014, 1016. Reinforcement members may be molded integrally with fifth and sixth members. Fifth and sixth members may be provided for additional support to screen openings of the screen 1010 and may be configured to have a minimal thickness through inclusion of reinforcement members, while providing the necessary structural support to maintain screen openings of the screen 1010 during sifter screening applications.

According to an exemplary embodiment of the present invention, a vibratory screen 10 includes a flexible molded polyurethane body 12 having substantially parallel side edge portions 14, 16 at opposite ends of body 12, a lower edge portion 18 substantially perpendicular to the side edge portions 14, 16, an upper edge portion 20 substantially perpendicular to the side edge portions 14, 16 and opposite the lower edge portion 18, an upper surface 22, a lower surface 24, first and second members 101, 102 forming screening openings 26, the first members 101 extending between the side edge portions 14, 16 and the second members 102 extending between the lower edge portion 18 and the upper edge portion 20. The body may also include third and fourth members 203, 204. Third and fourth members 203 and 204 may have a thickness greater than the first and second members 101, 102. Third members 203 are substantially parallel and extend transversely between the side edge portions 14, 16 and have multiple first members 101 therebetween. Fourth members 204 are substantially parallel and extend transversely between the lower edge portion 18 and the upper edge portion 20 and have multiple second members 102 therebetween. Reinforcement members 50 may be molded integrally with the third and/or fourth members 203, 204. Reinforcement rods 1050 may be molded integrally with fourth members 204. The body also includes fifth and sixth members 305, 306. Fifth members 305 are substantially parallel and extending transversely between the side edge portions 14, 16. Sixth members 306 are substantially parallel and extending transversely between the lower edge portion 18 and the upper edge portion 20. The fifth and sixth members have a thickness greater than the third and fourth members and include reinforcement members 50 molded integrally therewith. Reinforcement rods 1050 may be molded integrally with the sixth members 306. Vibratory screens according to this configuration may have open screening areas greater than forty percent and mesh sizes ranging from approximate 0.375 mesh to approximately 400 mesh. By way of example, screens tested having the aforementioned configuration include a 43 mesh size screen, a 140 mesh size screen and a 210 mesh size screen. Each of these screens had open screening areas of approximately 40 percent to approximately 46 percent. Such large screening areas for such fine mesh sizes are achieve through the relatively strong and thin grid framework created by the third, fourth, fifth and sixth members, 203, 204, 305, 306 and reinforcement members molded integrally therewith. In the aforementioned exemplary embodiment and examples, the size of each grid unit formed by the intersection of the third and fourth members, 203 and 204 is approximately 1" by 1". Generally, grid units may be larger for screens with larger screen openings and grid units are smaller for screens with smaller screen openings. This principle may be generally applicable for each example embodiment discussed herein. Grid units may also have a generally rectangular shape or any other suitable shape for supporting the screen openings.

According to an exemplary embodiment of the present invention, a screen deck assembly 1013 for an attrition screening device such as a sifter includes the above described polyurethane screens 1010, as well as a support deck 1011. In an exemplary embodiment, a first screen 1010, second screen 1010, and third screen 1010 may be attached to a single support deck 1011. In an alternative embodiment, additional or fewer screens 1010 may be included. The side edge portions 1014, 1016 of each of the first, second, and third screens 1010 may include grommets configured to mount the screens 1010 onto the support deck 1011. In an embodiment, each of the first, second, and third screens 1010 may be mounted onto the support deck 1011 and tensioned using a plurality of spring clips 1060 and/or cast-in tension strips 1025. The cast-in tension strips 1025 may be configured to distribute loads evenly across each screen 1010 and provide additional structural support for the grommets 1027 on the side edge portions 1014, 1016 of each of the first, second, and third screens 1010. In an exemplary embodiment, each of the first, second, and third screens 1010 may also include a first overlap sealing member 1019 and second overlap sealing member 1019 both attached to and extending away from an outer border of the lower edge portions 1018 of the each of the first and second screens 1010, the first overlap sealing member 1019 configured to overlap a portion of the second screen 1010, and the second overlap sealing member 1019 configured to overlap a portion of the third screen 1019, such that seals are formed between the screens 1010. According to an exemplary embodiment of the present invention, a method of making a vibratory screen, includes: creating a mold configured to fabricate the vibratory screen, the vibratory screening having a flexible molded polyurethane body; installing reinforcement members in the mold, the reinforcement members configured to be molded integrally with the body; installing reinforcement rods in the mold, the reinforcement rods configured to be molded integrally with the body, filling the mold with polyurethane; and forming the vibratory screen that has: substantially parallel side edge portions at opposite ends of the body, a lower edge portion substantially perpendicular to the side edge portions, an upper edge portion substantially perpendicular to the side edge portions and opposite the lower edge portion, an upper surface, a lower surface, first and second members forming screening openings, the first members extending between the side edge portions and the second members extending between the lower edge portion and the upper edge portion, third and fourth members, the reinforcement rods molded integrally with at fourth members, the third members substantially parallel and extending transversely between the side edge portions and having multiple first members therebetween, the fourth members substantially parallel and extending transversely between the lower edge portion and the upper edge portion and having multiple second members therebetween, reinforcement members molded integrally with at least one of the first and second members.

According to an exemplary embodiment of the present invention, a system for screening materials includes an attrition screening device such as a sifter and a screen deck assembly including a support deck 1011 and the above described polyurethane screens 1010 secured thereto. In an exemplary embodiment, a first screen 1010, second screen 1010, and third screen 1010 may be attached to a single support deck 1011. In an alternative embodiment, additional or fewer screens 1010 may be included. The side edge portions 1014, 1016 of each of the first, second, and third screens 1010 may include grommets configured to mount the screens 1010 onto the support deck 1011. In an embodiment, each of the first, second, and third screens 1010 may be mounted onto the support deck 1011 and tensioned using a plurality of spring clips 1060 and/or cast-in tension strips 1025. The cast-in tension strips 1025 may be configured to distribute loads evenly across each screen 1010. In an exemplary embodiment, each of the first, second, and third screens 1010 may also include a first overlap sealing member 1019 and second overlap sealing member 1019 both attached to and extending away from an outer border of the lower edge portions 1018 of the each of the first and second screens 1010, the first overlap sealing member 1019 configured to overlap a portion of the second screen 1010, and the second overlap sealing member 1019 configured to overlap a portion of the third screen 1019, such that seals are formed between the screens 1010. The screen deck assembly 1013 may be inserted into the attrition screening device for screening. Screens 1010 and screen deck assembly 1013 may include the various features described herein.

According to an exemplary embodiment of the present invention, a method of installing the above described screen deck assembly 1013 in an attrition screening device such as a sifter includes mounting a screen 1010 onto a support deck 1011 such that it forms a screen deck assembly 1013, inserting the screen deck assembly 1013 into the attrition screening device, and sifting a material. In an embodiment, the screen 1010 is mounted to the support deck 1011 and tensioned using a plurality of spring clips 1060 and/or cast-in tension strips 1025. Screens 1010 and screen deck assembly 1013 may include the various features described herein.

Now, these urethane screens are longer lasting, simpler in design, more easily removable and replaceable, lighter, and provide smaller, more consistent and accurate opening sizes than existing screens used in attrition screening devices such as sifters. The urethane screens do not have to be replaced for at least two months, as opposed to twice a week for current screens being used in attrition screening devices such as sifters. The non-blinding urethane configuration of the screens, including tapered screening openings, helps maintain a consistent feed rate over an extended period of operation of the attrition screening devices. Further, the superior properties exhibited by these screens eliminate the need for ball trays or ball boxes that are currently used in attrition screening devices such as sifters using wire screens to help de-blind the woven wire cloth. The elimination of the need for these ball trays or boxes has the additional benefit of reducing and/or eliminating the emission of hazardous airborne particles during the screening process, thus improving the health and safety of those operating these machines.

While preferred embodiments of the present invention have been disclosed, it will be appreciated that it is not limited thereto but may be otherwise embodied within the scope of the following claims.

What is claimed is:

1. A screen deck assembly, comprising:

a support deck;

a first screen, second screen, and third screen, each screen including a flexible molded polyurethane body having substantially parallel side edge portions at opposite ends of the body, a lower edge portion transversely disposed between the side edge portions, an upper edge portion disposed between the side edge portions and substantially parallel and opposite to the lower end portion, an upper surface, a lower surface, a first integrally molded grid structure, a second integrally molded grid structure, a third integrally molded grid structure and screen openings, wherein the first grid structure includes first and second members forming the screening openings, the first members substantially parallel and extending transversely between the side edge portions and the second members substantially parallel and extending transversely between the lower edge portion and the upper edge portion, wherein the second grid structure includes third and fourth members, the third members substantially parallel and extending transversely between the side edge portions and having multiple first members therebetween, the fourth members substantially parallel and extending transversely between the lower edge portion and the upper edge portion and having multiple second members therebetween, wherein the third grid structure includes fifth and sixth members, the fifth members substantially parallel and extending transversely between the side edge portions and having multiple third members therebetween, the sixth members substantially parallel and extending transversely between the lower edge portion and the upper edge portion and having multiple fourth members therebetween, wherein reinforcement members are molded integrally with at least one of the first, third, and fifth members and at least one of the second, fourth, and sixth members, wherein the side edge portions of each of the first, second, and third screens include attachment arrangements configured to secure the screens to the support deck, wherein the side edge portions of the first, second, and third screens are secured to the support deck.

2. The screen deck assembly of claim 1, wherein first members include reinforcement members molded integrally therewith, the reinforcement members having a thickness in the range of about 0.006 inches to about 0.015 inches.

3. The screen deck assembly of claim 1, wherein second members include reinforcement members molded integrally therewith, the reinforcement members having a thickness in the range of about 0.015 inches to about 0.040 inches.

4. The screen deck assembly of claim 1, wherein the first, second, and third screens are tensioned across the support deck.

5. The screen deck assembly of claim 4, wherein the first, second, and third screens are tensioned using a plurality of spring clips attached to the support deck.

6. The screen deck assembly of claim 1, wherein the attachment arrangement is a grommet.

7. The screen deck assembly of claim 1, further comprising a cast-in tension strip located within each of the side edge portions such that tension loads applied to the side edge portions are distributed across the screen.

8. The screen deck assembly of claim 7, wherein the side edge portions include apertures configured to fill up with polyurethane and suspend the cast-in tension strip in place within the side edge portions of the screen.

9. The screen deck assembly of claim 1, further comprising an overlap sealing member extending away from an outer edge of at least one of the lower edge portion and the upper edge portion of at least one of the screens.

10. The screen deck assembly of claim 9, wherein the sealing member is formed as part of the screens.

11. The screen deck assembly of claim 9, wherein the sealing member is formed as a separate member from the screens.

12. The screen deck assembly of claim 1, wherein the openings are about 0.044 mm to about 4 mm between inner surfaces of the first members and about 0.044 mm to about 60 mm between inner surfaces of the second members.

13. The screen deck assembly of claim 1, wherein the reinforcement members are molded integrally with the first and second members.

14. The screen deck assembly of claim 13, wherein the first members include reinforcement members molded integrally therewith, the reinforcement members having a thickness in the range of about 0.006 inches to about 0.015 inches, and wherein the second members include reinforcement members molded integrally therewith, the reinforcement members having a thickness in the range of about 0.015 inches to about 0.040 inches.

15. The screen deck assembly of claim 13, wherein reinforcement rods are molded integrally with at least one of the fourth and sixth members.

16. The screen deck assembly of claim 1, wherein the reinforcement members are molded integrally with the third and fourth members.

17. The screen deck assembly of claim 16, wherein reinforcement rods are molded integrally with at least one of the fourth and sixth members.

18. The screen deck assembly of claim 1, wherein the reinforcement members are molded integrally with the fifth and sixth members.

19. The screen deck assembly of claim 18, wherein reinforcement rods are molded integrally with at least one of the fourth and sixth members.

20. A screen deck assembly, comprising:

a support deck;

a screen including a flexible molded polyurethane body having substantially parallel side edge portions at opposite ends of the body, a lower edge portion substantially perpendicular to the side edge portions, an upper edge portion substantially perpendicular to the side edge portions and opposite the lower edge portion, an upper surface, a lower surface, a first integrally molded grid structure, wherein the first grid structure includes first and second members forming screening openings, the first members extending between the side edge portions and the second members extending between the lower edge portion and the upper edge portion, a second integrally molded grid structure, wherein the second grid structure includes third and fourth members, the third members substantially parallel and extending transversely between the side edge portions and having multiple first members therebetween, the fourth members substantially parallel and extending transversely between the lower edge portion and the upper edge portion and having multiple second members therebetween, wherein reinforcement members are molded integrally with at least one of the first and third members and at least one of the second and fourth members, wherein the side edge portions of the screen include attachment arrangements configured to secure the screen to the support deck, wherein the side edge portions of the screen are secured to the support deck.

21. The screen deck assembly of claim 20, wherein the first members include reinforcement members molded integrally therewith, the reinforcement members having a thickness in the range of about 0.006 inches to about 0.015 inches.

22. The screen deck assembly of claim 20, wherein the second members include reinforcement members molded integrally therewith, the reinforcement members having a thickness in the range of about 0.015 inches to about 0.040 inches.

23. The screen deck assembly of claim 20, wherein the screen is tensioned across the support deck.

24. The screen deck assembly of claim 23, wherein the screen is tensioned using a plurality of spring clips attached to the support deck.

25. The screen deck assembly of claim 20, wherein the attachment arrangement is a grommet.

26. The screen deck assembly of claim 20, further comprising a cast-in tension strip located within each of the side edge portions such that tension loads applied to the side edge portions are distributed across the screen.

27. The screen deck assembly of claim 26, wherein the side edge portions include apertures configured to fill up with polyurethane and suspend the cast-in tension strip in place within the side edge portions of the screen.

28. The screen deck assembly of claim 20, further comprising an overlap sealing member extending away from an outer edge of at least one of the lower edge portion and the upper edge portion of the screen.

29. The screen deck assembly of claim 28, wherein the sealing member is formed as part of the screen.

30. The screen deck assembly of claim 28, wherein the sealing member is formed as a separate member from the screens.

31. The screen deck assembly of claim 20, wherein the openings are about 0.044 mm to about 4 mm between inner surfaces of the first members and about 0.044 mm to about 60 mm between inner surfaces of the second members.

32. The screen deck assembly of claim 20, wherein the reinforcement members are molded integrally with the first and second members.

33. The screen deck assembly of claim 32, wherein the first members include reinforcement members molded integrally therewith, the reinforcement members having a thickness in the range of about 0.006 inches to about 0.015 inches, and wherein the second members include reinforcement members molded integrally therewith, the reinforcement members having a thickness in the range of about 0.015 inches to about 0.040 inches.

34. The screen deck assembly of claim 20, wherein the reinforcement member is an aramid fiber that is at least one of a twisted and a woven multistrand, wherein the fibers are about 55 denier to about 2840 denier.

35. The screen deck assembly of claim 32, wherein reinforcement rods are molded integrally with the fourth members.

36. The screen deck assembly of claim 20, wherein the reinforcement members are molded integrally with the third and fourth members.

37. The screen deck assembly of claim 36, wherein reinforcement rods are molded integrally with the fourth members.

38. The screen deck assembly of claim 20, further comprising a third integrally molded grid structure, wherein the third grid structure includes fifth and sixth members, the fifth members substantially parallel and extending transversely between the side edge portions and having multiple third members therebetween, the sixth members substantially parallel and extending transversely between the lower edge portion and the upper edge portion and having multiple fourth members therebetween.

39. The screen deck assembly of claim 38, wherein additional reinforcement members are molded integrally with the fifth and sixth members.

40. The screen deck assembly of claim 39, wherein reinforcement rods are molded integrally with at least one of the fourth and sixth members.

41. A method for separating materials, comprising:

installing a screen deck assembly in an attrition screening device, wherein the screen deck assembly includes a support deck and a first screen, second screen, and third screen, each screen including a flexible molded polyurethane body having substantially parallel side edge portions at opposite ends of the body, a lower edge portion substantially perpendicular to the side edge portions, an upper edge portion substantially perpendicular to the side edge portions and opposite the lower edge portion, an upper surface, a lower surface, a first integrally molded grid structure, wherein the first grid structure includes first and second members forming screening openings, the first members extending between the side edge portions and the second members extending between the lower edge portion and the upper edge portion, a second integrally molded grid structure, wherein the second grid structure includes third and fourth members, the third members substantially parallel and extending transversely between the side edge portions and having multiple first members therebetween, the fourth members substantially parallel and extending transversely between the lower edge portion and the upper edge portion and having multiple second members therebetween; wherein reinforcement members are molded integrally with at least one of the first and third members and at least one of the second and fourth members, wherein the side edge portions of each of the first, second, and third screens include attachment arrangements configured to secure the screens to the support deck, wherein the side edge portions of the first, second, and third screens are secured to the support deck; and sifting the materials using the screen deck assembly.

42. The method of claim 41, wherein the first members include reinforcement members molded integrally therewith, the reinforcement members having a thickness in the range of about 0.006 inches to about 0.015 inches.

43. The method of claim 41, wherein the second members include reinforcement members molded integrally therewith, the reinforcement members having a thickness in the range of about 0.015 inches to about 0.040 inches.

44. The method of claim 41, wherein the reinforcement members are molded integrally with the first and second members.

45. The method of claim 44, wherein the first members include reinforcement members molded integrally therewith, the reinforcement members having a thickness in the range of about 0.006 inches to about 0.015 inches, and wherein the second members include reinforcement members molded integrally therewith, the reinforcement members having a thickness in the range of about 0.015 inches to about 0.040 inches.

46. The method of claim 44, wherein reinforcement rods are molded integrally with the fourth members.

47. The method of claim 41, wherein the reinforcement members are molded integrally with the third and fourth members.

48. The method of claim 47, wherein reinforcement rods are molded integrally with the fourth members.

49. The method of claim 41, wherein the screen deck assembly includes a third integrally molded grid structure, wherein the third grid structure includes fifth and sixth members, the fifth members substantially parallel and extending transversely between the side edge portions and having multiple third members therebetween, the sixth members substantially parallel and extending transversely between the lower edge portion and the upper edge portion and having multiple fourth members therebetween.

50. The method of claim 49, wherein additional reinforcement members are molded integrally with the fifth and sixth members.

51. The method of claim 50, wherein reinforcement rods are molded integrally with at least one of the fourth and sixth members.

52. A system for separating materials comprising:

an attrition screening device;

a screen deck assembly installed in the attrition screening device for separating the materials, the screen deck assembly including a support deck and a first screen, second screen, and third screen, each screen including a flexible molded polyurethane body having substantially parallel side edge portions at opposite ends of the body, a lower edge portion substantially perpendicular to the side edge portions, an upper edge portion substantially perpendicular to the side edge portions and opposite the lower edge portion, an upper surface, a lower surface, a first integrally molded grid structure, wherein the first grid structure includes first and second members forming screening openings, the first members extending between the side edge portions and the second members extending between the lower edge portion and the upper edge portion, a second integrally molded grid structure, wherein the second grid structure includes third and fourth members, the third members substantially parallel and extending transversely between the side edge portions and having multiple first members therebetween, the fourth members substantially parallel and extending transversely between the lower edge portion and the upper edge portion and having multiple second members therebetween; wherein reinforcement members are molded integrally with at least one of the first and third members and at least one of the second and fourth members, wherein the side edge portions of each of the first, second, and third screens include attachment arrangements configured to secure the screens to the support deck, wherein the side edge portions of the first, second, and third screens are secured to the support deck.

53. The system of claim 52, wherein the first members include reinforcement members molded integrally therewith, the reinforcement members having a thickness in the range of about 0.006 inches to about 0.015 inches.

54. The system of claim 52, wherein the second members include reinforcement members molded integrally therewith, the reinforcement members having a thickness in the range of about 0.015 inches to about 0.040 inches.

55. The system of claim 52, wherein the reinforcement members are molded integrally with the first and second members.

56. The system of claim 55, wherein the first members include reinforcement members molded integrally therewith, the reinforcement members having a thickness in the range of about 0.006 inches to about 0.015 inches, and wherein the second members include reinforcement members molded integrally therewith, the reinforcement members having a thickness in the range of about 0.015 inches to about 0.040 inches.

57. The system of claim 55, wherein reinforcement rods are molded integrally with the fourth members.

58. The system of claim 52, wherein the reinforcement members are molded integrally with the third and fourth members.

59. The system of claim 58, wherein reinforcement rods are molded integrally with the fourth members.

60. The system of claim 52, further comprising a third integrally molded grid structure, wherein the third grid structure includes fifth and sixth members, the fifth members substantially parallel and extending transversely between the side edge portions and having multiple third members therebetween, the sixth members substantially parallel and extending transversely between the lower edge portion and the upper edge portion and having multiple fourth members therebetween.

61. The system of claim 60, wherein additional reinforcement members are molded integrally with the fifth and sixth members.

62. The system of claim 61, wherein reinforcement rods are molded integrally with at least one of the fourth and sixth members.

* * * * *